US011222774B2

(12) United States Patent
Kozhinov et al.

(10) Patent No.: US 11,222,774 B2
(45) Date of Patent: Jan. 11, 2022

(54) DATA ACQUISITION APPARATUS AND METHODS FOR MASS SPECTROMETRY

(71) Applicant: SPECTROSWISS SÀRL, Lausanne (CH)

(72) Inventors: Anton Kozhinov, Lausanne (CH); Yury Tsybin, Saint-Sulpice (CH); Konstantin Nagornov, Préverenges (CH)

(73) Assignee: SPECTROSWISS SÀRL, Lausanne (CH)

( * ) Notice: Subject to any disclaimer, the term of this patent is extended or adjusted under 35 U.S.C. 154(b) by 627 days.

(21) Appl. No.: 16/090,446

(22) PCT Filed: Mar. 31, 2017

(86) PCT No.: PCT/IB2017/051867
§ 371 (c)(1),
(2) Date: Oct. 1, 2018

(87) PCT Pub. No.: WO2017/168389
PCT Pub. Date: Oct. 5, 2017

(65) Prior Publication Data

US 2019/0043704 A1 Feb. 7, 2019

(30) Foreign Application Priority Data

Apr. 1, 2016 (WO) ..... PCT/IB2016/051887

(51) Int. Cl.
*H01J 49/00* (2006.01)

(52) U.S. Cl.
CPC ..... *H01J 49/0036* (2013.01)

(58) Field of Classification Search
CPC ..... H01J 49/0036
See application file for complete search history.

(56) References Cited

U.S. PATENT DOCUMENTS

2006/0132346 A1 6/2006 Tryggvason et al.
2007/0136017 A1* 6/2007 Wang ..... H01J 49/0027 702/85

FOREIGN PATENT DOCUMENTS

WO 2016/004542 1/2016

OTHER PUBLICATIONS

Lange, Oliver, et al., "Enhanced Fourier transform for Orbitrap mass spectrometry," International Journal of Mass Spectrometry, vol. 369, 2014, pp. 16-22.

(Continued)

*Primary Examiner* — Yoshihisa Ishizuka
(74) *Attorney, Agent, or Firm* — Nixon & Vanderhye P.C.

(57) ABSTRACT

A data acquisition system for acquiring a digitized time-domain signal and corresponding mass spectra from a mass spectrometer. The system comprises a signal conditioning device including an amplifier and an analog low-pass filter, to amplify and filter an analog signal generated by the mass spectrometer, and to output a conditioned analog signal; an analog-to-digital converter to convert in real time the conditioned analog signal into a digital data stream; a digital signal processing device having an in-line digital signal processing device for processing the digital data stream to generate the digitized time-domain signal, and to digitally decode a digital triggering signal from the mass spectrometer; and a host device having a data processing device to receive the digitized time-domain signal from the digital signal processing device, and to construct a corresponding mass spectra from the digitized time-domain signal.

21 Claims, 16 Drawing Sheets

(56) References Cited

OTHER PUBLICATIONS

Marshall, Alan G., et al., "40 years of Fourier transform ion cyclotron resonance mass," International Journal of Mass Spectrometry, vol. 377, 2015, pp. 410-420.
Scigelova, Michaela, et al., "Fourier Transform Mass Spectrometry," Molecular & Cellular Proteomics 10.7, 2011, M111.009431, 19 pages.
Zubarev, Roman A., et al., "Orbitrap Mass Spectrometry," Analytical Chemistry, vol. 85, 2013, pp. 5288-5296.
International Search Report for PCT/IB2017/051867, dated Jul. 31, 2017, 5 pages.
Written Opinion of the ISA for PCT/IB2017/051867, dated Jul. 31, 2017, 8 pages.
Xiaofang et al., "Time Measurement System Based on Waveform Digitization for Time-of-Flight Mass Spectrometer", IEEE Transactions On Nuclear Science, vol. 60, No. 6, Dec. 1, 2013, pp. 4588-4594.

* cited by examiner

DATA ACQUISITION APPARATUS AND METHODS FOR MASS SPECTROMETRY

This application is the U.S. national phase of International Application No. PCT/IB2017/051867 filed 31 Mar. 2017, which designated the U.S. and claims priority to International Patent Application No. PCT/IB2016/051887 filed 1 Apr. 2016, the entire contents of each of which are hereby incorporated by reference.

FIELD OF THE INVENTION

The present invention relates generally to measuring mass-to-charge (m/z) ratios and abundances of ions of interest in a mass spectrometer. More particularly, this invention relates to devices, methods, and systems for the automatic acquisition of digitized time-domain (transient) signals and corresponding mass spectra, from an analog signal generated in response to ion motion in a mass spectrometer by a transducer that employs induced current sensing for ion detection. The invention may be used in conjunction with those mass spectrometers that employ a Fourier transform (FT) mass analyzer, such as an ion cyclotron resonance (ICR) cell or an electrostatic ion trap (e.g, an orbitrap), for acquiring digitized transient signals and corresponding mass spectra with improved analytical characteristics relative to the prior art.

BACKGROUND OF THE INVENTION

1. Description of the Prior Art

Mass spectrometry. Mass spectrometry (MS) is one of the most sensitive and selective analytical techniques for molecular structural and quantitative analyses. To provide molecular level information on samples from solid, liquid, or gas phase state, it is required to first transform molecules into charged particles (ions), then to separate the formed ions by their mass-to-charge ratios, m/z, and finally record the abundance of each species as a function of m/z values. The main analytical characteristics of mass spectrometric techniques include resolving power (or resolution), mass accuracy, dynamic range, sensitivity, and acquisition speed (throughput). Resolving power, or resolution, refers to an ability of a mass spectrometer to distinguish molecular species that are close in their m/z values. High resolving powers are needed to analyze complex molecular mixtures and to provide required levels of mass measurement accuracy. Sensitivity refers to the ability of mass spectrometers to detect minor amounts of components from a sample. The lowest amount of ions that a mass spectrometer is capable of detecting is referred to as detection limit. The complex molecular mixtures analysis includes analysis of isotopic fine structures of biomolecules, specifically peptides and proteins, as well as analysis of isotopic distribution of large biomolecules, e.g., proteins. Comprehensive analyses of crude oils and crude oil fractions require many analytical characteristics, including resolving power, mass accuracy, and dynamic range, to be all at sufficiently high levels. Mass spectrometry has already revolutionized the way we consider molecular structural analysis nowadays, but the extreme sample complexity in many cases still cannot be addressed even by the most sophisticated instruments. The major application areas of MS nowadays are in life, pharmaceutical, clinical, environmental, material, and forensic sciences.

Fourier transform mass spectrometry (FTMS) is the leading mass spectrometric technology in terms of available resolving power and mass accuracy. In FTMS, periodic ion motion over a given period of time, e.g., from a hundred of milliseconds up to minutes, is analyzed via induced current detection (sensing) principle. Thus measured time-domain signals (transients) are typically comprised of sinusoidal components. Each of these components is characterized by an amplitude, frequency, and phase. Transients can be converted into frequency spectra using discrete Fourier transform (DFT) or other methods of signal processing, e.g., filter-diagonalization method (FDM), least-squares fitting (LSF), or phased spectrum deconvolution method (PSDM). The latter one uses alternating directions method of multipliers (ADMM) to deconvolve the Fourier spectra. The known relations between ion motion frequencies and m/z values of ions allow converting the frequency spectra into mass spectra. Thus, frequency-to-m/z conversion (using several known compounds in order to calibrate such conversion) provides accurate mass measurements. Low-ppm and sub-ppm mass accuracy levels are achievable nowadays even for MS analyses of very complex mixtures such as crude oils. Provided that each ion packet corresponding to all m/z values of interest is sufficiently coherent, the resolving power achieved with Fourier transform-based signal processing is directly proportional to the transient duration (detection period). The two main types of the FTMS instruments nowadays are Fourier transform ion cyclotron resonance mass spectrometers (FT-ICR MS) and Orbitrap FTMS. The former employs static magnetic field for periodic ion motion development, whereas the latter is with an electrostatic field based mass analyzer (viz, an orbitrap). The most commonly employed ionization technique is electrospray ionization (ESI), which produces multiply charged molecular species. Another important method of ion formation is matrix assisted laser desorption ionization (MALDI).

In Orbitrap FTMS, ions are generated externally to the orbitrap and are transferred to the orbitrap by pulsed injection of well confined ion packets. When ions are being transferred into the orbitrap, ion excitation by injection takes place and ions get trapped into the rings of ions, where each ring comprises ions of the same m/z value, which coherently oscillate along the central spindle electrode of the orbitrap. The specific shape of static electric field created between the spindle and detection electrodes allows for prolonged, up to several seconds, coherent motion of ion rings. The frequency of the axial oscillations is related to the m/z values in question. By design, Orbitrap FTMS has a feature that in the first-order theoretical approximation there exists a point of phase intersection in time, where time-dependent phases of all ions trapped in the orbitrap are equal. The practical aspect of the phase intersection point is in facilitated implementation of those methods of signal processing that use not only the amplitude values but also the initial phase values of Fourier components of a transient signal generated by the axial oscillations. Such signal processing methods include absorption-mode FT, as well as various non-FT methods. For example, absorption-mode FT is extremely useful for Orbitrap FTMS applications, as it allows reducing the required transient duration twice without a loss in obtained resolving power. Recently, the algorithm known as enhanced FT (eFT) has been implemented, which is heavily based on absorption-mode FT processing. The use of the eFT algorithm is particularly favorable for applications in life sciences, where experiments are performed with tight time constraints due to the use of sophisticated on-line liquid-phase separation techniques. Nevertheless, the use of the initial phase values with signal processing methods other than the eFT algorithm, e.g., absorption-mode FT and LSF, should also be beneficial for FTMS applications. Moreover, in FT-ICR MS implementation of absorption-mode FT is more complicated than in Orbitrap FTMS. In an ICR cell of an FT-ICR mass spectrometer ions are usually excited sequentially in time from the cell's axis toward larger orbits of ion circulation, closer to the detection electrodes. Therefore, there is no point of phase intersection where the time-dependent phases of all ions trapped in the ICR cell are equal. Construction of the corresponding phase function is thus more complicated. In practice, to enable absorption mode spectral representation in FT-ICR MS, each experimental configuration of interest is to be calibrated using a complex mixture of molecules that provide mass spectra with many different ions, in order to construct the phase function in question. Once such calibration is performed, absorption-mode FT can be applied to subsequent (or the same) acquisition events of mass spectral data (transients). Errors in phase functions, viz. those induced by non-linear phase distortion, either for Orbitrap FTMS or for FT-ICR MS, lead to introduction of artifacts, e.g., baseline roll, peak splitting, and peak asymmetry, in mass spectra, resulting in reduced analytical characteristics of such data. Therefore, there is a need in appropriate solutions allowing substantial reduction of the phase distortion and, preferably, providing mass spectral data without the necessity of data post-processing.

Data acquisition systems. Data acquisition (DAQ) is defined as the automatic collection of data from sensors of measurement instruments. In the context of mass spectrometers with induced current sensing, data acquisition refers to converting analog signals generated by a signal transducer connected to a Fourier transform mass analyzer (e.g., an orbitrap, an ICR cell) of such mass spectrometer, into digitized transients, i.e., sequences of voltages discretely sampled in time, for further use. A DAQ system usually consists of different DAQ components, including a signal conditioning analog circuitry, an analog-to-digital converter, a data bus, and a host computer. DAQ systems based on various hardware platforms have been used in FTMS, including: custom-built electronics, ISA (Industry Standard Architecture), GPIB (General Purpose Interface Bus), VXI (Versa module europa eXtension for Instrumentation), PCI (the Peripheral Component Interconnect), and PXI (PCI eXtensions for Instrumentation). Architecture of the FTMS data acquisition systems that have been used until now can usually be described with a common block diagram as depicted in FIG. 1A. As detailed below, disadvantages of such hardware architecture are: (i) it does not provide capabilities for sophisticated in-line processing of digitized signals and for advanced triggering of data acquisition, as well as (ii) its analog anti-aliasing filter(s) and analog-to-digital converter(s) are designed based solely on the frequency range of ions of interest.

Referring to FIG. 1A, an analog signal that is generated in a mass spectrometer by an induced current sensing transducer is routed, possibly through one or more amplification stages, to the analog input (AI) 01 of the DAQ system. After entering the DAQ system, the signal passes through an analog circuitry for signal conditioning 02 before it reaches an analog-to-digital converter (ADC) 03. The analog circuitry 02 includes signal amplification and low-pass anti-aliasing filtering, which are required to make the signal suitable for the ADC. Specifically, the circuitry 02 provides one (A1) or several (A1, A2, . . . , An, n>1) factors for amplification, as well as one (K1) or several (K1, K2, . . . , Km, m>1) cut-off frequencies for anti-aliasing filtering. Some of these options may possibly be implemented as a single electronic unit (e.g., a variable-gain amplifier (VGA) whose gain is controlled with an external signal), whereas the others as separate electronic units (e.g., a number of individual analog filters, each with a pre-set cutoff frequency). Without loss of generality, the available set of amplification factors and cut-off frequencies are illustrated as separate elements of the block diagram (viz., the elements 07, 08, and 09 denoting the amplification factors A1, A2, and An, as well as the elements 10, 11, and 12 denoting the cut-off frequencies K1, K2, and Km), whereas selecting given amplification factor and cut-off frequency of the analog signal path within the circuitry 02 is illustrated with switches 13 and 14, respectively, which are pre-set by a host computer 06 before acquiring a transient signal.

The ADC, 03, is usually configured to produce a digital data stream at a sample rate that is twice exceeding the highest fundamental frequency of ions of interest. The main reason for such sample rate is in the minimum number of samples according to the Nyquist-Shannon-Kotelnikov sampling theorem. After the ADC converts the continuous signal in question into a digital stream, such digital data passes to a specialized integral circuitry (IC) or, sometimes a low-performance field-programmable-gate array (FPGA), 04, which controls digitization of individual transients. Specifically, the digital circuitry 04 is employed for basic processing of the data stream and communication with a host computer, 06. In terms of signal processing, the circuitry 04 usually implements an acquisition mode with fixed-size records, thus relying on an in-advance specified number (e.g., received from the host computer 06) of samples to acquire into a finite-size data buffer of the DAQ system. Thus, each digital transient begins according to a start trigger generated by a mass spectrometer and ends once the specified number of samples (data points) is acquired. The main reason for such mode is in its straightforward implementation, as well as in computing power and algorithms of the host computer, 06, being optimized for processing transients whose numbers of samples are a multiple of 2 (e.g., 262144 samples, 524288 samples, and so on up to the limit due to the buffer's size). Finally, individual digitized transients are transferred to the host computer 06 through a data bus 05 for further signal processing, e.g. Fourier transformation.

Periodic sampling. Digital signal processing (DSP) is generally defined as the numerical manipulation of discrete sequences of amplitudes, including for measuring, filtering, compressing, and generating continuous signals. Usually, the discrete sequences in question are either obtained in result of sampling of continuous signals or synthesized numerically in order to generate continuous signals. In terms of periodic sampling, an important question in the DSP theory is what sample rate permits to capture all the information from a continuous signal. In other words, what sample rate must be used when periodically sampling a continuous signal into a discrete sequence, in order to be able to reconstruct the original continuous signal from thus obtained discrete sequence? Given the (finite) bandwidth of the continuous signal, the Nyquist-Shannon-Kotelnikov sampling theorem, which is otherwise known as the cardinal theorem of interpolation, establishes a sufficient condition for the sample rate (frequency) fs in question: fs>B, where B is the full bandwidth (i.e., in the sense of both positive and negative frequencies, if any) of a Fourier spectrum of the continuous signal. Besides, also known as Shannon's theorem, there exists a corollary from the sampling theorem, according to which, given that a continuous signal contains no frequencies higher than b, this signal can be reconstructed from its discrete sequence if the sampling frequency, fs, is higher than twice the frequency b: fs>2b. This inequality is known as the Nyquist criterion, while the frequencies 2b and fs/2 are known as the Nyquist rate and the Nyquist frequency (folding frequency), respectively.

When a discrete sequence is obtained by sampling a signal at a rate fs, the discrete-time Fourier transform (DTFT) of such discrete sequence contains multiple replicas of the Fourier spectrum of the original signal. These replicas are centered at frequencies f=n·fs, where n is 0, ±1, ±2, etc. When the sampling theorem's conditions are not met (under-sampling mode), an effect of aliasing is happening causing different continuous signals to become indistinguishable by their sampled versions. As a result, at least two replicas, viz. those at n±1, fold over the folding frequency thus causing distortions of the replica at n=0 which in turn represents a spectrum of interest. Thus, for signals whose frequency band (in the sense of non-negative frequencies) is an interval [0, b), the Nyquist rate defines the minimum sampling frequency with which the periodic spectral replicas do not intersect.

In many applications, a frequency region of interest, [0, fmax), is less or much less than the bandwidth b of a signal that is used to carry the Fourier (frequency) components in question. Hence, the required sampling frequency is: $fs=2b>>2f_{max}$, which results in excessive amounts of digital data. As such, the traditional approach for periodic sampling is heavily based on analog filtering before analog-to-digital conversion. Specifically, an analog signal of interest is passed through an analog anti-aliasing filter (i.e. a low-pass, and usually high-order, filter based on analog electronic circuitries) with a cut-off frequency, $f_0$, that is set about the maximum frequency of interest: $f_0 \approx f_{max}$. Therefore, sampling the filtered signal at a sample rate of as low as about $2f_0$ is allowed, i.e. $fs \approx 2f_{max}$, thus making for minimum amounts of resulting digital data.

An alternative approach is based on digital filtering after analog-to-digital conversion. It comprises sampling at the high rate, $fs>>2f_{max}$, followed by passing thus acquired digital sequence through a digital filter and a digital sample rate converter in order to downsample this sequence to a new, lower sample rate, fds. According to the sampling theorem, the new rate may be as low as $2f_{max}$, i.e.$fds \approx 2f_{max}$, thus minimizing amounts of digital data (similarly to the case with anti-aliasing analog filtering of the traditional approach above). Specifically, the discrete sequence may be passed through a digital anti-aliasing filter, e.g., a finite impulse response filter (FIR), with a cut-off frequency that is set at $f_0 \approx f_{max}$, followed by digital re-sampling at $fds \approx 2f_{max}$. In particular, to carry out an integer, k-fold, downsampling, e.g. k=32, the re-sampling may be performed via decimation with a factor of k, whereas the cut-off frequency of the filter may be set at $f_0 \approx fs/(2k)$ or lower, thus providing a digital sequence whose number of samples is k-fold less than in the original sequence, and whose frequency band is $[0, f_0)$. An impulse response, as exemplified in FIG. 2, defining such FIR filter may be numerically synthesized using standard DSP algorithms for generating a FIR filter with desired properties of its transfer function (e.g., the cut-off frequency $f_0$).

It may seem that the two approaches above are equivalent, while they are not. As described below, the traditional approach with analog processing has certain disadvantages relative to the DSP approach in terms of their performance characteristics. Yet, it has not been long since when the DSP approach was actually made applicable in practice due to recent progress in digital technologies. DAQ systems of the prior art are usually based on the traditional approach.

Overview articles on FT-ICR MS and Orbitrap FTMS are, for example: Marshall A. G., Chen T.: 40 years of Fourier transform ion cyclotron resonance mass spectrometry. International Journal of Mass Spectrometry 2015, 377, 410-420; Scigelova M., Hornshaw M., Giannakopulos A., Makarov A.: Fourier transform mass spectrometry. Molecular & Cellular Proteomics 2011, 10, M111.009431; Zubarev R. A., Makarov A.: Orbitrap mass spectrometry. Analytical Chemistry 2013, 85, 5288-5296; Lange O., Damoc E., Wieghaus A., Makarov A Enhanced Fourier transform for Orbitrap mass spectrometry. International Journal of Mass Spectrometry 369 (2014) 16-22.

2. Problems Encountered in Prior Art

First, sampling frequency employed in FTMS data acquisition systems according to the prior art, FIG. 1A, is typically relatively low, e.g. 1 . . . 5 MHz, and is aimed to be about twice the maximum ion fundamental frequency of interest. To avoid spectral aliasing, the switch 14 is set to select an analog filter with a cut-off frequency that is preferably close to, but not exceeding, one-half the sample rate. Because such filter is: (i) analog, (ii) usually of high order (typically, from 6 to 11), and (iii) its cut-off frequency is relatively low, such filter induces substantial non-linear phase distortions to the signal at the signal conditioning stage, 02, and thus to the digitized transient signal. Indeed, across the filter's passband the phase response is essentially non-linear (viz., it can be approximated with a high-order polynomial function), and the range between the maximum and minimum values is $k\pi/2$, where k is the filter's order. By example, FIG. 3A shows amplitude and phase characteristics of a DAQ system with a 6-order Chebyshev filter having a cut-off frequency $f_0$ according to the prior art (e.g., $f_0$=2.2 MHz).

Hence, it is important to realize that a signal with which the sampling theorem holds true is now the signal with phase distortions, and is different from the original input signal of interest. Therefore, the digitized data does not allow to unambiguously represent the original analog signal. Specifically, the phase information stored in the original signal is corrupted in the digital signal, which complicates the use of those signal processing methods that benefit from the phase information. Thus, current data acquisition systems employed for FTMS use analog anti-aliasing filters with relatively low cut-off frequencies, which cannot provide accurate phase information. Although higher sampling frequencies, e.g., 16 or 32 MHz, are employed sometimes (e.g., when a low-performance FPGA is used in place of the IC), a high sampling frequency is a necessary condition, but not a sufficient condition, to avoid introducing phase distortions. For example, increasing the sample rate does not reduce phase distortions in question if such filter is tuned to low cut-off frequencies as above. Additionally, phase distortions may take place during transient downsampling, if implemented, to a lower sample rate given reduced precision of digital algorithms of low-performance FPGAs.

The inability of a data acquisition system to accurately record the phase information of transients and to not introduce artifacts during these measurements, especially at higher frequencies of interest, viz. at around 1 MHz, reduces the efficiency and accuracy of absorption-mode FT processing. Information on the phases of ion signals is also important for performance of other methods of signal processing, not only for absorption mode FT. For example, the speed of mass analysis can be increased if the required transient duration per experiment can be shortened. To achieve that, super-resolution methods of signal processing, e.g., least-squares fitting or filter diagonalization, may be used instead of FT. However, their performance drastically depends on the accuracy of phase information recording provided by the data acquisition system. Finally, high accuracy of phase measurement is also important for transients containing non-sinusoidal but also periodic functions. FT processing of such transients would produce spectra with many harmonics. To reduce the number of these harmonics as well as to increase the achievable resolution, other than FT methods of signal processing are needed, for example extended-basis FT processing. However, for these methods to function properly, it is preferred that data acquisition systems do not introduce any non-linear phase distortion to digitized transient signals.

Secondly, due to the acquisition mode with fixed-size records of DAQ systems from the prior art, their duty cycle of data acquisition is not optimal, as depicted in FIG. 4A. Here, a digital signal 33 represents multiple events of ion injection into a mass analyzer (for example the falling edges of such signal) and multiple events of ion ejection from the mass analyzer (for example the rising edges of such signal), thus defining a number of consecutive mass spectral scans within which the ions are trapped in the mass analyzer for periods of time Ti, i=0, 1, etc. In general, these periods of time, Ti, are not necessarily equal to each other. Importantly, each period of time Ti is usually longer than a pre-selected detection period T. Hence, with digital transients, 34, acquired according to the prior art, only a part, T, of the full time Ti is used for data acquisition: T<Ti. Another disadvantage of the acquisition mode with fixed-size records is in potentially longer cycle times of the mass spectrometer when acquiring digitized transients with increased amounts of data points. The main reason for that could be due to longer data processing by the host computer, 06, and limited speed with which the data is transferred through the bus, 06. Likewise, the maximum detection period T per each transient is rather limited (e.g., about 1.5 s or sometimes about 40 s) since the maximum number of samples per each record is limited by the data buffer's size of the digital part of the DAQ system's block diagram, FIG. 1A. From the analytical perspective, these restrictions can result in the upper limit for the achievable resolution when isobaric molecules with very close masses need to be distinguished. Longer cycle times lead to reduced number of mass spectra acquired in a unit of time, thus limiting the qualitative and quantitative molecular information in time-constraint measurements, for example in MS-based proteomics where separation techniques are on-line hyphenated with the MS for analysis of very complex molecular mixtures.

Thirdly, there exist other limitations due to the signal conditioning stage, 02, as depicted in FIG. 5. For example, mutual mis-tuning of different cascades of the analog filter (one cascade per each order) may result in reduction of the signal-to-noise ratio (S/N) when the analog signal in question passes through the filter. Likewise, reduction in the S/N value may also take place due to introducing digital noise at the analog-to-digital conversion stage, 03, when the amplification factor (which is usually pre-set by the host computer 06 for a given MS scan) of the signal conditioning stage, 02, is not suitable (e.g., under-estimated), as depicted in FIG. 6. Performance of FTMS mass analyzers, including an orbitrap and an ICR cell, depends on the number of charges available for ion detection, on the variation of this number of charges between the consecutive measurements, as well as on the distribution of the total charge between different channels (different ion species). Particularly, mass accuracy, resolution, and sensitivity performance suffer from these variations, primarily due to the space-charge effects. To overcome these limitations, different devices and methods to control the total number of charges participating in each mass measurement have been introduced. In one particular implementation for FTMS, it is known as an automated gain control for injection of a certain number of charges into a mass analyzer. This function requires a pre-scan that determines total ion current value from a short measurement. One or several subsequent (longer) measurements utilize this information by accumulating ions for a period of time calculated using the estimated total ion current value.

However, in a reality, transient amplitude may substantially vary between subsequent measurements even if such function is enabled. Specific examples can be listed for bottom-up and top-down proteomics applications, as well as imaging MS. In bottom-up proteomics, however, oftentimes, reaching the pre-set value of charges, for example 100,000 charges, may take an unacceptably long time when low abundance ions are to be measured. Typically, to avoid such time conflicts, an upper limit of time (maximum ion injection or ion accumulation time) is specified, for example 100 ms. Therefore, when low abundance ions are to be measured, the accumulated ion population may be significantly lower than the one required for efficient mass measurement. As a priori this information is not available, the parameters of the data acquisition system are set to ensure accurate recording of data as if the target charge value is reached in each mass measurement. Therefore, operation of data acquisition system may not be optimal when the required number of ions (charges) for ion detection is not provided. Particular examples of bottom-up approaches suffering from this limitation are data-independent proteomics and phospho-/glycoproteomics where exceptional sensitivity levels of mass measurements are required. In top-down proteomics as well as native mass spectrometry, where large, for example 50 kDa, molecules are analyzed, the pre-set target charge values are typically higher than for the small molecule analysis. Primarily, that is done to compensate the precursor signal distribution into many channels upon extensive charging of a precursor ion as well as precursor ion transformation in the reaction cell of a mass spectrometer—known as tandem mass spectrometry operation. However, the extent to which precursor ion will convert into the product ions is a priori not known. Therefore, the parameters of the data acquisition system are set to ensure accurate recording of data from the precursor ion—that is to digitize the total ion charge value. However, ion signal split into many channels may lead to a significant reduction of transient amplitude. Indeed, in top-down mass spectrometry or proteomics of intact proteins a transformation of a large ion population, e.g., 5e6 charges, at a selected m/z range into hundreds to thousands channels with very diverse numbers of ions (charges) per channel takes place upon fragmentation. Therefore, without additional amplification, digitization of such transients is not efficient and potentially lead to reduced sensitivity in mass spectra.

As such, the prior art method of signal recording with under-estimated amplification gain (which is, specifically, set the same for a given target charge value and a scan type, MS or $MS^n$) for MS or $MS^n$ experiments, as depicted in FIGS. 9 and 10, can potentially lead to reduced sensitivity, as the amplitude of a transient signal is reduced for ion fragmentation scan $MS^n$ compared to the MS scan, especially for proteins, FIG. 10. As an example, left column of FIG. 10 shows transient and mass spectrum of the isolated charge states of a precursor protein. Right panel of FIG. 10 shows resulting transient and mass spectrum following fragmentation of isolated precursor ions, for example using electron transfer dissociation. Similar deviations of transient signal amplitude form scan to scan are typical in experiments with a fluctuating ion source, for example MALDI experiments. Unpredictable fluctuation of ion currents which may span orders of magnitude between the single scans in real-life FTMS experiments leads to destructive influence of space charge effects in the mass analyzers, for example in orbitrap. As a result, important analytical characteristics, e.g., mass accuracy, resolution and sensitivity became scan-dependent. It is thus not surprising that combination of Orbitrap FTMS with fluctuating ion sources is not readily present on the market, or underperforming when employed. Specifically, one of the most powerful and promising technique of today—MALDI imaging, with recent developments in molecular pathology and other clinical applications, has not been adopted yet commercially to an Orbitrap FTMS platform. Similar limitations are known to exist for FT-ICR MS with moderate, less than 7 T, magnetic fields. On the other hand, high, 9-15 T, magnetic fields in modern FT-ICR MS reduce the influence of space charge effects to a certain degree and these instruments have shown the best resolution and mass accuracy performance in MALDI imaging up to date. Nevertheless, even these instruments require development of sophisticated mass scale recalibration routines as scan-to-scan (or pixel-to-pixel) variation of mass spectra performance is present. In addition to MALDI, rapid fluctuations in ion currents are frequent in fast separations (liquid chromatography and capillary electrophoresis) prior to ESI MS. Indeed, modern proteomics and metabolomics experiments require fast separations, meaning a quick change in the number of charges from scan to scan. Under such conditions, charge number estimation (for example using automatic gain control function) becomes erroneous. Therefore, an ion signal data acquisition system should properly respond to the 10-100 fold changing number of charges from scan to scan to maximize the sensitivity of these and other applications with variations in ion population, for example in tandem mass spectrometry, as described above. Similarly, the speed (throughput) of mass analysis suffers from both reduced sensitivity and an upper limit of resolution achievable in a given period of time. To increase the sensitivity of measurements, several scans (e.g., more than 100) can be averaged in time or spectral domain. As the signal-to-noise ratio (SNR) scales as square root of the number of scans, increase in the SNR value per scan by 2-4 fold provides significant increase in speed of data acquisition—resulting in respectively 4-16 times faster data acquisition. These values are given as examples.

To summarize, the data acquisition systems employed in Fourier transform mass spectrometry possess a number of disadvantages. These systems digitize analog transient signals with losses of information (e.g., introduction of phase distortions), reduced sensitivity (e.g., introduction of digital and analog noise), non-optimal timing (e.g., reduced duty cycle of data acquisition), requirements for extensive data post-processing (e.g., phase correction, calculations of combined spectra from absorption mode and magnitude mode spectra), and limited number of samples (e.g., the upper limit in available detection periods). As a result, the sensitivity, resolution, and acquisition speed of mass spectral data in FTMS suffer. Notably, similar limitations exist in other Fourier transform-based methods and techniques of molecular structural analysis, e.g., nuclear magnetic resonance spectroscopy and infrared spectroscopy.

SUMMARY OF THE INVENTION

It is an objective of the present invention to increase the performance of mass spectrometry in general and FTMS in particular by rationally designing a data acquisition system that enables advanced triggering of data acquisition and sophisticated in-line digital signal processing (DSP), as well as advanced signal conditioning, thus allowing acquisition of time-domain data and mass spectra without certain limitations of the prior art such as substantial phase distortions, requirements for extensive data post-processing, digital and analog noise, non-optimal duty cycles of data acquisition, and upper-limits in detection periods.

The present invention provides an apparatus and allied methods for acquisition of mass spectral data, such as digitized time-domain (transient) signals and corresponding mass spectra, from an analog signal generated in response to ion motion in a mass spectrometer by a transducer that employs induced current sensing for ion detection, enabling:

a) data acquisition without introduction of substantial phase distortions and analog noise to digitized transient signals;
b) data acquisition with maximized duty cycle of transient signal digitization, as well as without pre-setting detection periods of transient signals;
c) data acquisition with automatic gain control (AGC) functionality for eliminating introduction of substantial digital noise to digitized transient signals.

More specifically, in a first aspect, the invention provides a data acquisition system for acquiring a digitized time-domain signal and corresponding mass spectra from a mass spectrometer. The system comprises a signal conditioning device including an amplifier and an analog low-pass filter, to amplify and filter an analog signal generated by the mass spectrometer, and to output a conditioned analog signal; an analog-to-digital converter to convert in real time the conditioned analog signal into a digital data stream; a digital signal processing device having an in-line digital signal processing device for processing the digital data stream to generate the digitized time-domain signal, and to digitally decode a digital triggering signal from the mass spectrometer; and a host device having a data processing device to receive the digitized time-domain signal from the digital signal processing device, and to construct a corresponding mass spectra from the digitized time-domain signal.

In a preferred embodiment, the mass spectrometer is a Fourier transform mass spectrometer used for ion detection of a signal transducer based on induced current sensing.

In a further preferred embodiment, a passband of the analog low-pass filter of the signal conditioning device, regarding positive-value frequencies, is exceeded at least twice by a fundamental frequency of ion motion in the mass spectrometer for a lowest m/z value of interest. An amplification factor of the amplifier of the signal conditioning device is set to a value such that a voltage level of the conditioned analog signal closely approaches but does not exceed a voltage range of the analog-to-digital converter for signal voltage levels corresponding to ion motion in the mass spectrometer for total ion charges of interest.

In a further preferred embodiment, a sampling frequency of the analog-to-digital converter exceeds at least twice the passband of the analog low-pass filter regarding positive-value frequencies.

In a further preferred embodiment, the in-line digital signal processing device comprises a digital decoder to decode a start event and a stop event when generating each individual digitized transient signal in the mass spectrometer, a detection of the stop event is performed by using the digital triggering signal from the mass spectrometer; a digital valve to distinguish individual digitized transient signals in the digital data stream, according to the start event and the stop event; and a digital downsampler based on a digital low-pass filter for reducing data of the individual digitzied transient signals, the digital low-pass filter providing a phase function close to a linear function of frequency, a deviation from the linear function resulting from limitations of a digital implementation of the digital low-pass filter.

In a further preferred embodiment, the data processing device of the host device performs further processing of the digitized time-domain signal.

In a further preferred embodiment, the signal conditioning device comprises n amplifiers and n analog low-pass filters, n being in integer number greater than 1, amplification factors of the n amplifiers being divergent to cover two orders of magnitude, such that the signal conditioning device is configured to amplify and filter the analog signal generated by the mass spectrometer and to output n conditioned analog signals to the analog-to-digital converter.

In a further preferred embodiment, the analog-to-digital converter comprises n analog-to-digital converters, n being in integer number greater than 1, the n analog-to-digital converters configured to convert in real time the n conditioned analog signals into n digital data streams.

In a further preferred embodiment, the digital valve comprises n digital valves, n being in integer number greater than 1, the n digital valves configured to distinguish the individual digitized transient signals in the digital data stream, according to the start event and the stop event. The digital downsampler includes n digital downsamplers, the n digital downsamplers configured to process the individual digitized transient signals from the digital data stream.

In a further preferred embodiment, the in-line digital signal processing device further comprises an amplitude analyzer configured to reject one or more digital data streams from the n digital data streams that are clipped, and configured to select from remaining n digital data streams the ones that were acquired with maximum amplification factor.

In a further preferred embodiment, the data processing device of the host device performs a data-dependent decision to control an operating parameter of the digital signal processing device.

In a further preferred embodiment, the data processing device of the host device performs a data-dependent decision to control an operating parameter of the mass spectrometer.

In a further preferred embodiment, the data acquisition system further comprises an additional analog input for recording a signal of ion excitation from the mass spectrometer.

In a second aspect, the invention provides adata acquisition method for acquiring digitized time-domain signals and corresponding mass spectra from a mass spectrometer. The method comprises signal conditioning an analog signal in response to ion motion in the mass spectrometer, the signal conditioning including amplificating and anti-aliasing the analog signal to produce a conditioned analog signal; analog-to-digital converting the conditioned analog signal into a digital data stream; digital signal processing of the digital data stream, and digital decoding of a digital triggering signal from the mass spectrometer; and constructing corresponding mass spectra from the digital data stream.

In a further preferred embodiment, the mass spectrometer is a Fourier transform mass spectrometer using ion detection a signal transducer that is based on induced current sensing.

In a further preferred embodiment, a passband of the anti-aliasing, regarding positive-value frequencies, exceeds at least twice fundamental frequency of ion motion in the mass spectrometer for the lowest m/z value of interest. An amplification factor of the amplifying is set to a value such that a voltage level of the conditioned analog signal closely approaches but does not exceed a voltage range of the analog-to-digital converter for signal voltage levels corresponding to ion motion in the mass spectrometer for total ion charges of interest.

In a further preferred embodiment, a sampling frequency of the analog-to-digital converting exceeds by at least twice the passband of the anti-aliasing regarding positive-value frequencies.

In a further preferred embodiment, the step of digital signal processing comprises decoding a start event and a stop event when generating each individual digital transient signal in the mass spectrometer, a detection of the stop event is performed by using the digital triggering signal from the mass spectrometer; distinguishing individual digitized transient signals in the digital data stream, based on the start event and the stop event; and digital downsampling with a digital low-pass finite-impulse response (FIR) filtering for reducing data of the individual digitized transient signals, the digital low-pass FIR filter providing a phase function close to a linear function of frequency, a deviation from the linear function resulting from limitations of a digital implementation of the digital low-pass FIR filter.

In a further preferred embodiment, the step of constructing the mass spectra includes data processing including at least one of signal apodization, zero-padding, Fourier transformation, calculating an absorption-mode Fourier spectrum, and conversion of a frequency axis into a mass-to-charge axis for obtaining resultant mass spectra.

In a further preferred embodiment, the step of signal conditioning, the analog-to-digital converting, the distinguishing individual digitized transient signals, and the digital downsampling are performed with n diverse amplification factors, n being an integer greater than 1, the diverse amplification factors covering two orders of magnitude, to produce n digital variants for each individual transient signal.

In a further preferred embodiment, the digital signal processing further comprises analyzing amplitudes of the n digital to reject one or more digital variants from the n digital variants that are clipped, and selecting from remaining n variants the ones that were acquired with maximum amplification factor.

In a further preferred embodiment, the data acquisition method further comprises making a data dependent decision to control an operating parameter of the step of digital signal processing.

In a further preferred embodiment, the data acquisition method further comprises making a data dependent decisions to control an operating parameter of the mass spectrometer.

In a further preferred embodiment, a linear property of the phase function is parametrized for time-domain least-squares fitting to calculate an initial phase of ions oscillating in the mass spectrometer.

In a further preferred embodiment, the initial phase of ions is used to calculate an absorption mode Fourier spectrum.

In a further preferred embodiment, ions included in a pre-defined region of a full mass spectrum are submitted for ion detection using a Fourier transform mass analyzer, and ions included in a complementary part of the mass spectrum are submitted for ion detection using another mass analyzer.

In a further preferred embodiment, the data acquisition method further comprises the step of multiplexed quantificating of protein using isobaric mass tags, using tandem mass spectrometry (MS/MS)-based quantification.

In a further preferred embodiment, a linear property of the phase function is parametrized for time-domain least-squares fitting for calculating ion abundances for the protein multiplexed quantification.

In a further preferred embodiment, the data acquisition method further comprises the step of submitting ions for multistage tandem mass spectrometry, for example using an ion trap mass analyzer, with product ion detection taking place in a Fourier transform mass analyzer.

In a further preferred embodiment, the data acquisition method further comprises the step of multiplexed quantificating protein using isobaric mass tags using MS/MS/MS-based quantification.

In a further preferred embodiment, a linear property of the phase function is parametrized for time-domain least-squares fitting for calculating ion abundances for the protein multiplexed quantification.

In a further preferred embodiment, the data acquisition method further comprises the step of measuring m/z and abundances of ions for tandem mass spectrometry of large biomolecular ions.

In a third aspect, the data acquisition method is applied to applications that involve detection of ions or neutrals produced via desorption from solid or liquid surfaces as in matrix assisted laser desorption ionization (MALDI) and desorption electrospray ionization (DESI).

In a further preferred embodiment, the application is imaging mass spectrometry.

In a further preferred embodiment, the data acquisition method further comprises the step of improving analytical characteristics in data-independent mass spectrometry-based proteomics.

BRIEF DESCRIPTION OF THE DRAWINGS

The invention will be understood through the description of preferred embodiments and in reference to the drawings, wherein.

DETAILED DESCRIPTION OF THE INVENTION

The present invention provides an apparatus and methods for acquisition of mass spectral data, such as digitized time-domain (transient) signals and corresponding mass spectra, from an analog signal generated in response to ion motion in a mass spectrometer by a transducer that employs induced current sensing for ion detection.

The proposed apparatus is distinct from the prior art, in particular, by its back-end with a high-performance field-programmable gate array (FPGA) chip for advanced triggering of data acquisition and sophisticated in-line digital signal processing (DSP), as well as by its front-end for advanced signal conditioning. The present invention enables:

a) data acquisition without introduction of substantial phase distortions and analog noise to digitized transient signals;
b) data acquisition with maximized duty cycle of transient signal digitization, as well as without pre-setting detection periods of transient signals;
c) data acquisition with automatic gain control (AGC) functionality for eliminating introduction of substantial digital noise to digitized transient signals.

Figure 1A:
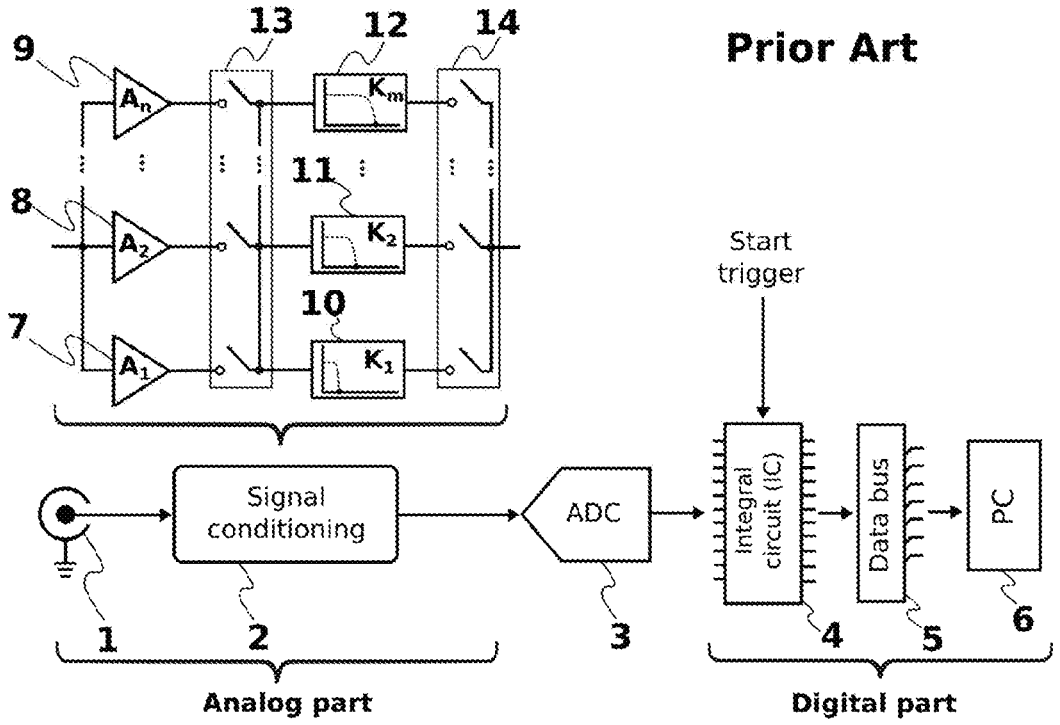
FIG. 1A is a schematic block diagram representation of an FTMS data acquisition system according to the prior art.
Figure 1B:
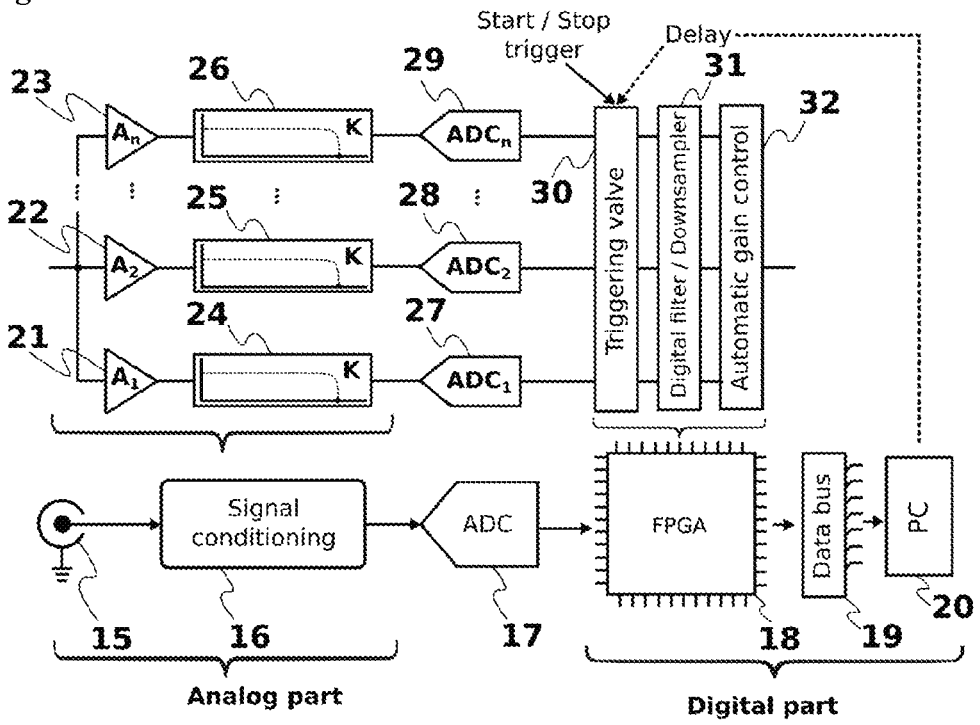
FIG. 1B is a schematic block diagram representation of an example of an apparatus according to the present invention.
Figure 2:
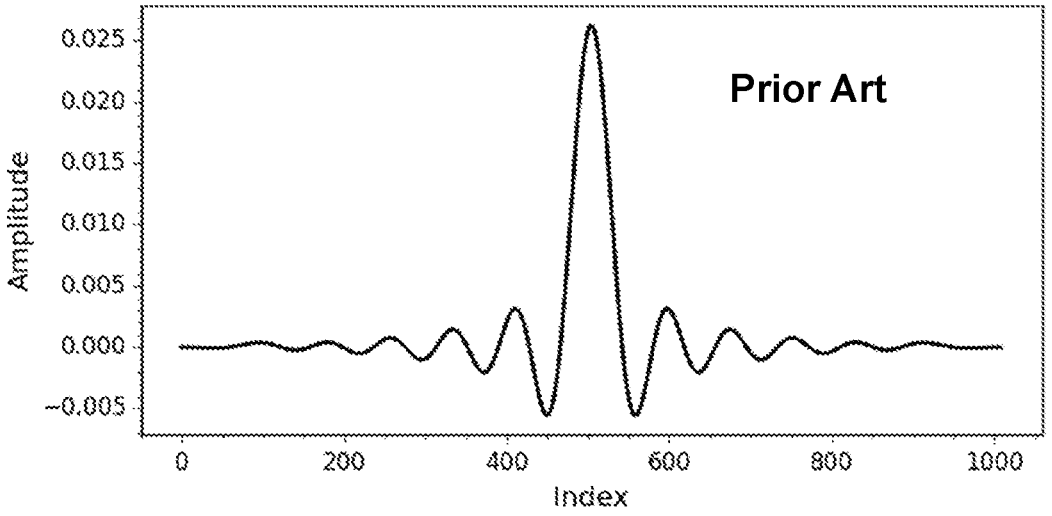
FIG. 2 shows impulse response of an example of a finite-impulse response filter (FIR) according to the prior art.

FIG. 1B is a schematic block diagram representation of an example of an apparatus according to the present invention. An analog signal that is generated in a mass spectrometer by an induced current sensing transducer is routed, possibly through one or more amplification stages, to the analog input (AI) 15 of the apparatus. After entering the apparatus, the signal passes through a signal conditioning sub-system, 16, which amplifies and filters the continuous analog signal from the mass spectrometer. Thus conditioned analog signal further passes to an analog-to-digital conversion sub-system, 17, which converts in real time said conditioned analog signal into a continuous stream of digital data. Next, this stream is sent to a digital signal processing sub-system, 18, which is based on a field-programmable gate array (FPGA) chip, for triggering of data acquisition and for in-line digital signal processing (DSP) of said digital stream. Finally, individual digitized transients are transferred to a host computer, 20, through a data bus, 19, for further signal processing, e.g. absorption-mode Fourier transformation.

The signal conditioning sub-system 16 provides one or more signal paths (e.g., n=4), each including an amplifier, 21-23, followed by a broad-band analog anti-aliasing filter, 24-26. The amplification factors (gain levels) of all the n amplifiers are pre-set to diverse values, e.g., covering two orders of magnitude. The amplification factors are preferably different, but some of them may be equal. The filters are of the same type and of the same order to have preferably identical amplitude-frequency and amplitude-phase characteristics. It is essential that, unlike in the prior art, these filters have a passband width that is exceeding, in the sense of positive-value frequencies, by at least ten-fold the fundamental frequency of ion motion in the mass spectrometer for the lowest m/z value of interest (for example, the passband ranging from DC to 50 . . . 125 MHz if the fundamental frequency of ion motion is 5 MHz for the lowest m/z value of interest).

The analog-to-digital conversion sub-system provides one or more ADCs (e.g., n=4), 27-29, one ADC per each of the analog paths in the signal conditioning sub-system, 16. For each of the n signal-conditioned variants of the input signal, a corresponding ADC produces a digital stream of samples. It is essential that, unlike in the prior art, the ADCs operate with a sample rate exceeding at least twice the full passband of said analog filter in the sense of positive-value frequencies (for example, the sample rate of 100 . . . 250 MHz if the passband width is 50 . . . 125 MHz in the sense of positive-value frequencies).

Figure 4A:
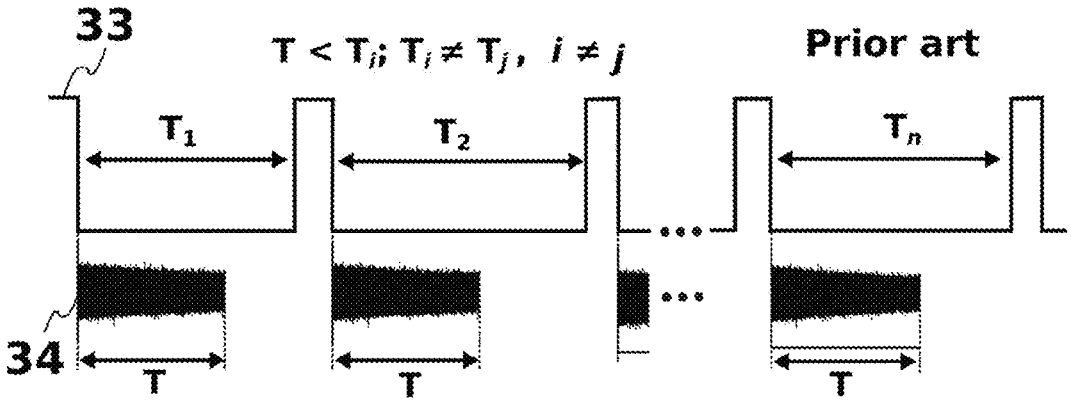
FIG. 4A is a schematic flow diagram representation of data acquisition with an FTMS data acquisition system according to the prior art.
Figure 4B:
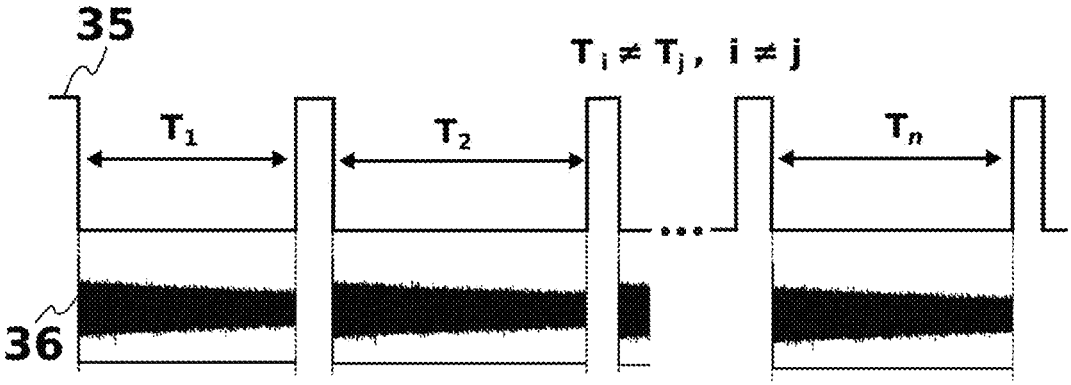
FIG. 4B is a schematic flow diagram representation of data acquisition with an example of an apparatus according to the present invention.
Figure 7A:
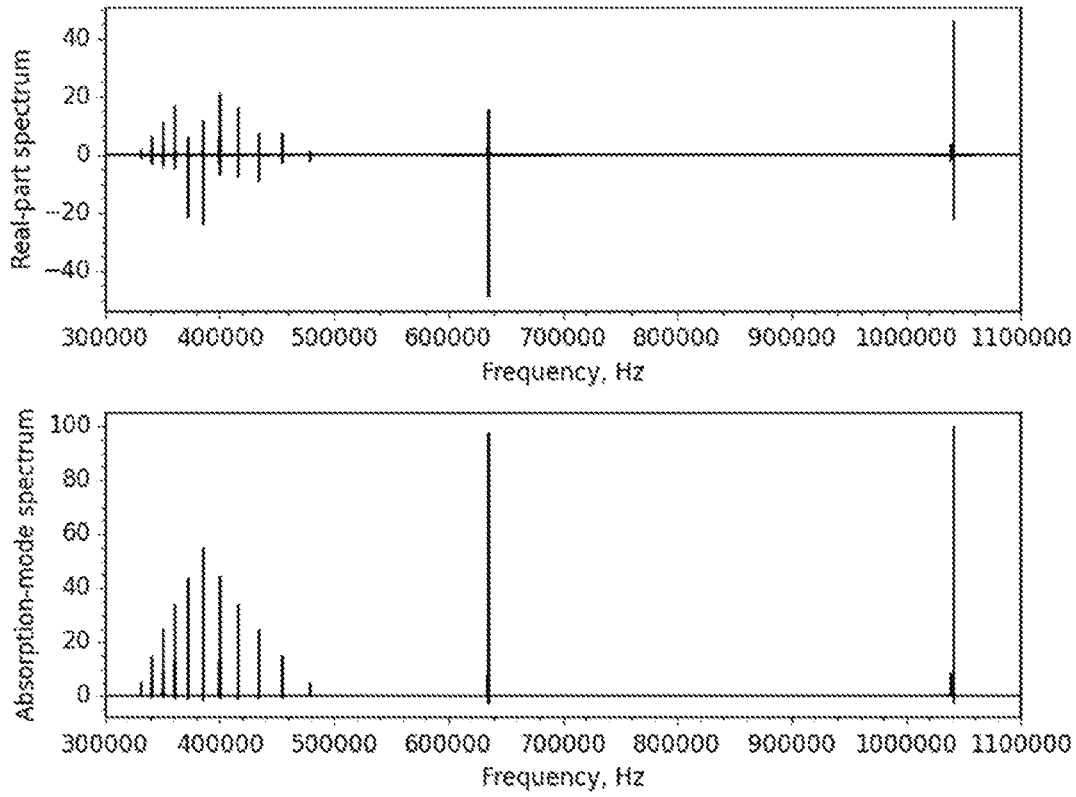
FIG. 7A shows real-part Fourier spectra of two transient signals of 13 compounds of a calibration mixture (calibrants): top panel, demonstrating a mixed-mode display, corresponds to the simulations for the prior art with phase distortions; bottom panel, demonstrating the correct absorption-mode display, corresponds to an example of an apparatus according to the present invention.
Figure 7B:
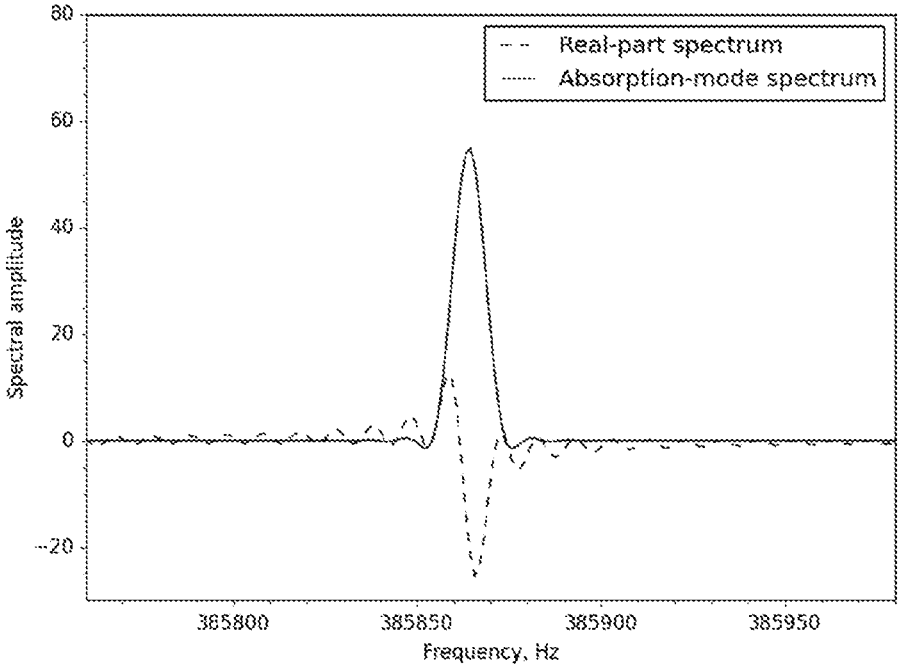
FIG. 7B shows a magnified view in the two spectra of FIG. 7A in the frequency region around one of the calibrants.

The digital signal processing sub-system provides a digital triggering valve, 30, digital filter-downsampler, 31, and, if n>1, a digital implementation of automatic gain control (AGC), 32, for selecting a digital signal corresponding to a suitable analog path in the signal conditioning sub-system, 16. The triggering valve controls the n digital streams so that all the streams are either blocked or passed further based on a digital decoder. The digital decoder controls the valve by decoding the start and stop events in generation of each individual transient signal in order to achieve an optimal (maximized) duty cycle of data acquisition, as depicted in FIG. 4B. Here, a digital signal 35 represents multiple events of ion injection to a mass analyzer (for example the falling edges of such signal) and multiple events of ion ejection from the mass analyzer (for example the rising edges of such signal), thus defining a number of consecutive mass spectral scans within which the ions are trapped in the mass analyzer for periods of time Ti, i=0, 1, etc. These periods of time, Ti, are not necessarily equal to each other. Acquisition of digital transients, 36, takes the full available time Ti. The digitized transients are sent to the host computer in a form suitable for absorption mode Fourier transform processing, FIG. 7. No phase correction pre-processing is required on the host computer side. Additionally, unlike in the prior art, the transient data is acquired without imposing limits on the maximum detection period T of a transient signal.

Figure 3A:
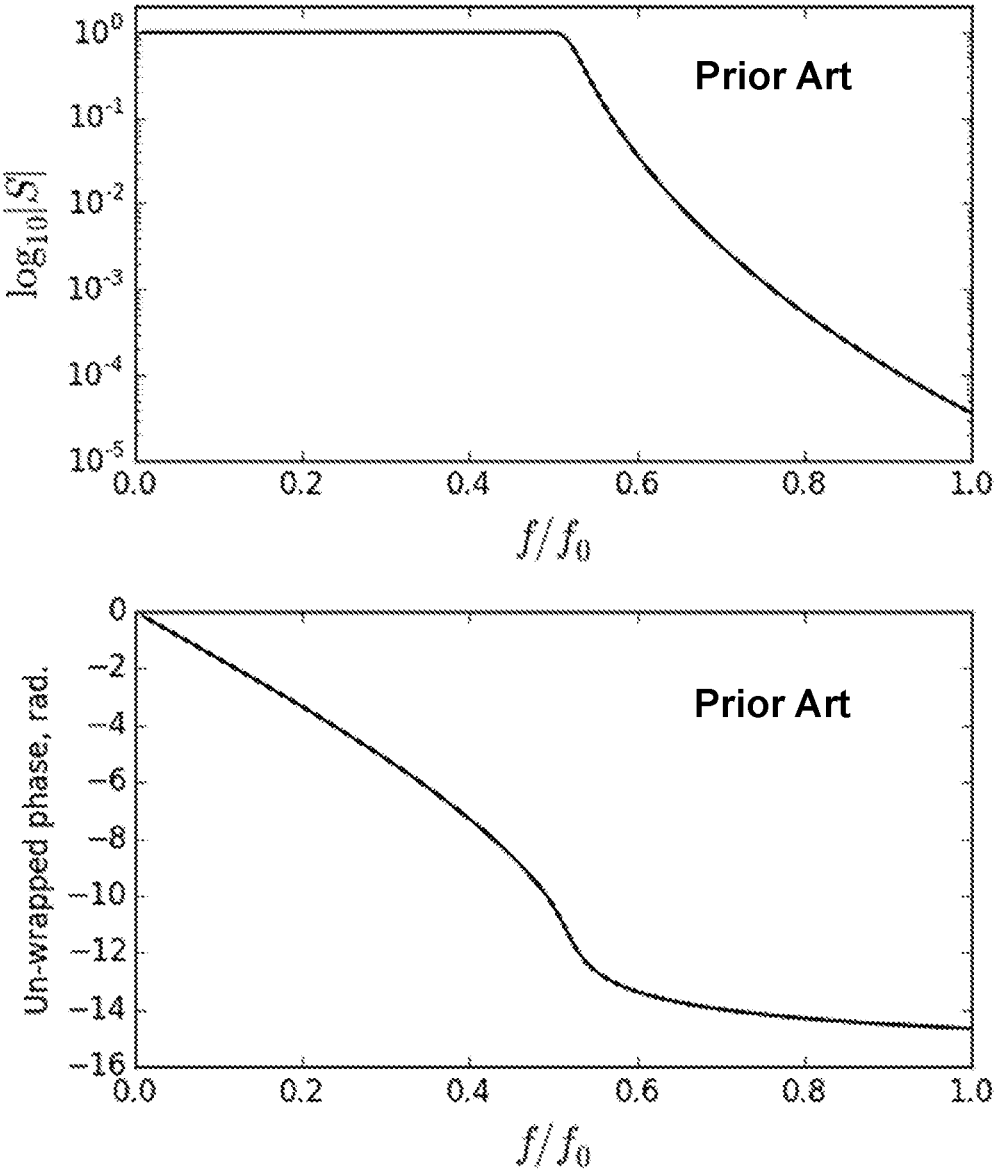
FIG. 3A shows an example of amplitude (top panel) and phase (bottom panel) characteristics of an FTMS data acquisition system according to the prior art.
Figure 3B:
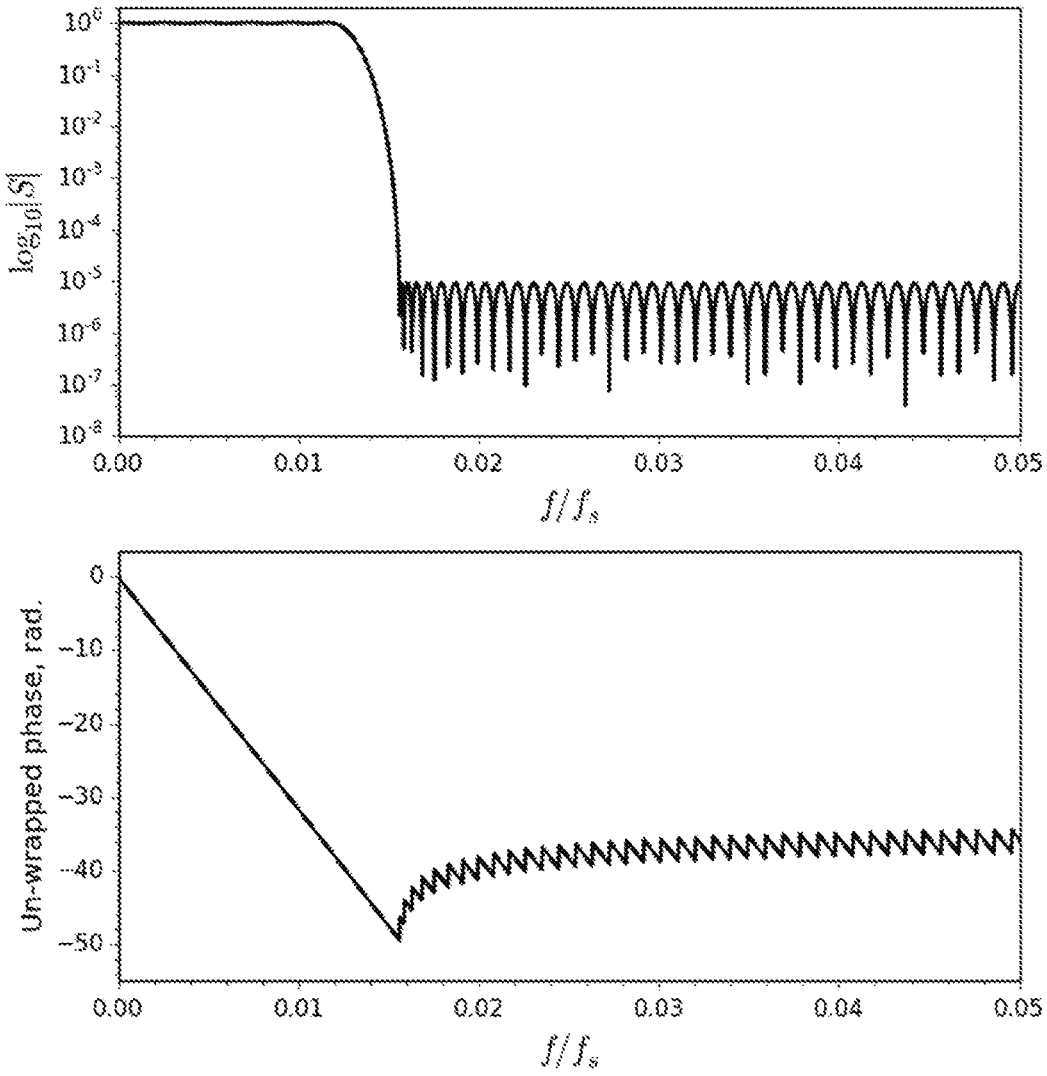
FIG. 3B shows amplitude (top panel) and phase (bottom panel) characteristics of an example of an apparatus according to the present invention.

The digital filter-downsampler, 31 is a digital integer downsampler with a digital finite-response filter (FIR) processing the n data streams in parallel. The digital downsampler produces decimated digital transient signals with a passband width of 1 . . . 2 the fundamental frequency of ion motion for the lowest m/z value of interest (e.g., if the original sampling frequency is 250 MHz, a decimation factor of 64 results in the sample rate of 3.90625 MHz and the passband ranging from DC to 3 . . . 3.9 MHz). The digital filter is preferably of high dynamic range. It is essential that, unlike in the prior art, no substantial non-linear phase perturbations is induced to thus acquired digital transient signals, as illustrated in FIG. 3B. Specifically, the digital filter is synthesized to obtain a linear phase function with any non-linear deviations from this linear function being below a desirable level.

Figure 5:
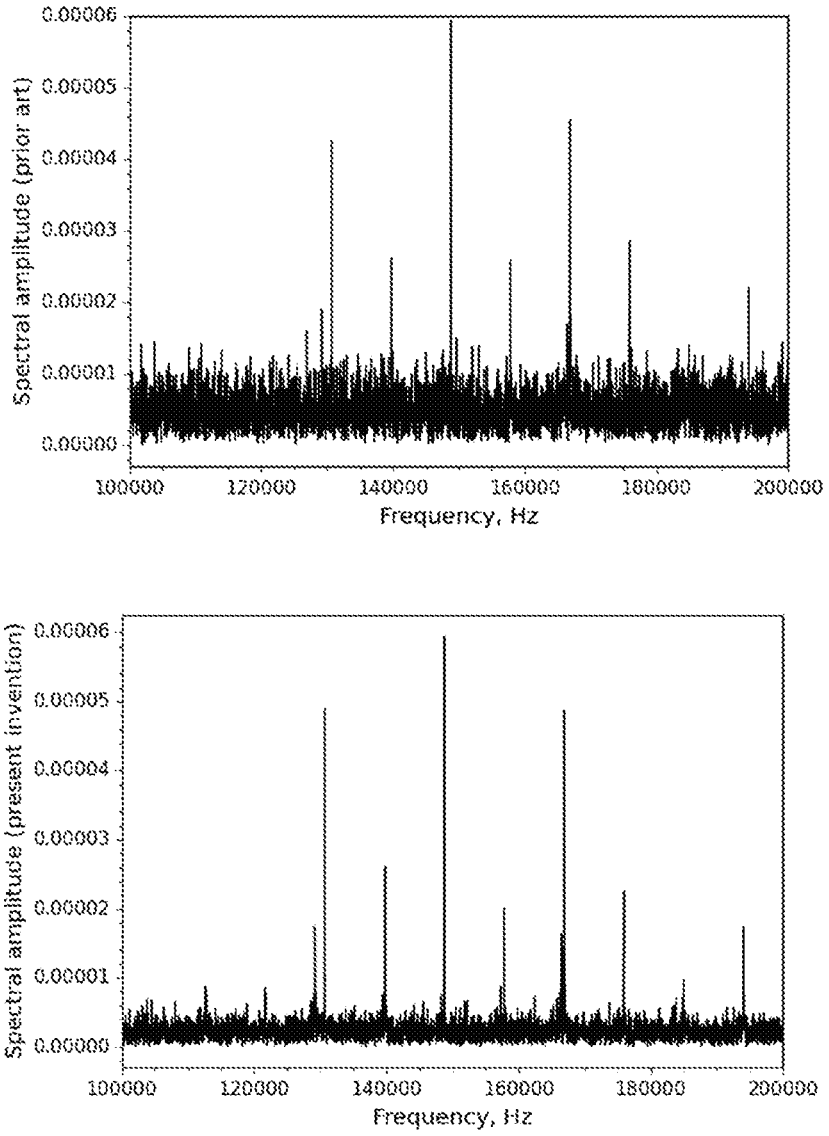
FIG. 5 shows comparison of noise levels, including contributions of both analog and digital noise components, in mass spectra obtained from two transient signals acquired in parallel in the same analysis of ions in a mass spectrometer: one transient signal was acquired using an FTMS data acquisition system according to the prior art (mass spectrum in top panel), the other transient signal was acquired using an example of an apparatus according to the present invention (mass spectrum in bottom panel)
Figure 6:
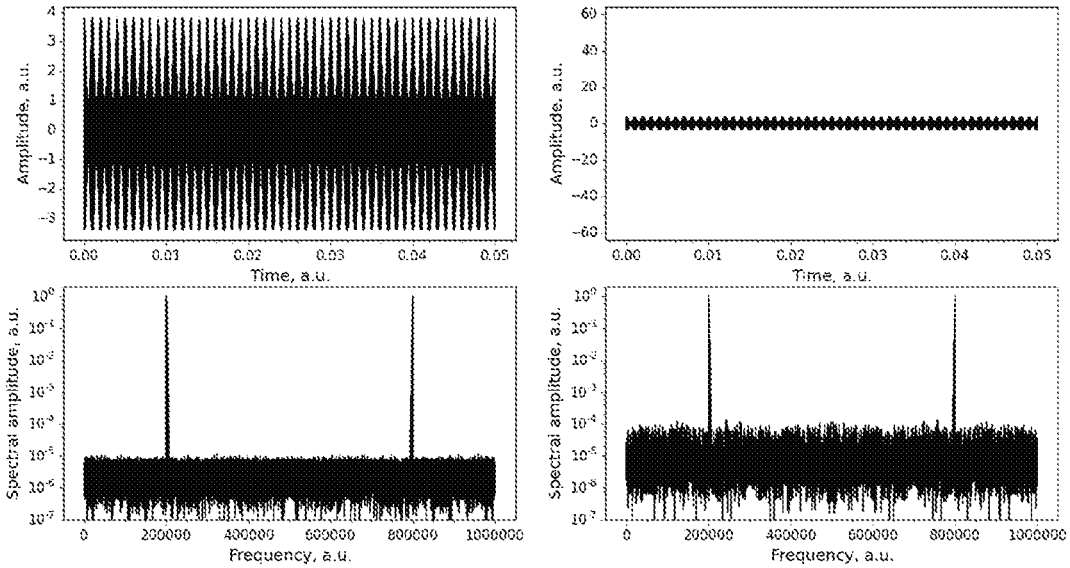
FIG. 6 shows comparison of digital noise levels in mass spectra (bottom panels) obtained from two transient signals (top panels) simulated for the prior art with insufficient amplification (mass spectrum in right bottom panel) and simulated for an example of an apparatus according to the present invention with the automatic gain control (AGC) functionality for signal amplification (mass spectrum in left bottom panel)

Unlike in the prior art, an input analog filter that defines the bandwidth of resulting digital transients is the digital filter in question, whereas the anti-aliasing filter has a relatively high frequency cut-off as described above. This allows avoiding limitations in electronic designs of analog filters of the prior art. Likewise, to avoid reduction in the S/N value due to introducing digital noise at the analog-to-digital conversion stage, a suitable amplification factor of the signal conditioning stage must be set, as follows from simulated data in FIG. 6. Therefore, FIG. 5 shows cumulative improvement in the signal-to-noise ratio (S/N) in experimental mass spectra due to reduced analog and digital noise in question relative to the prior art.

Figure 8:
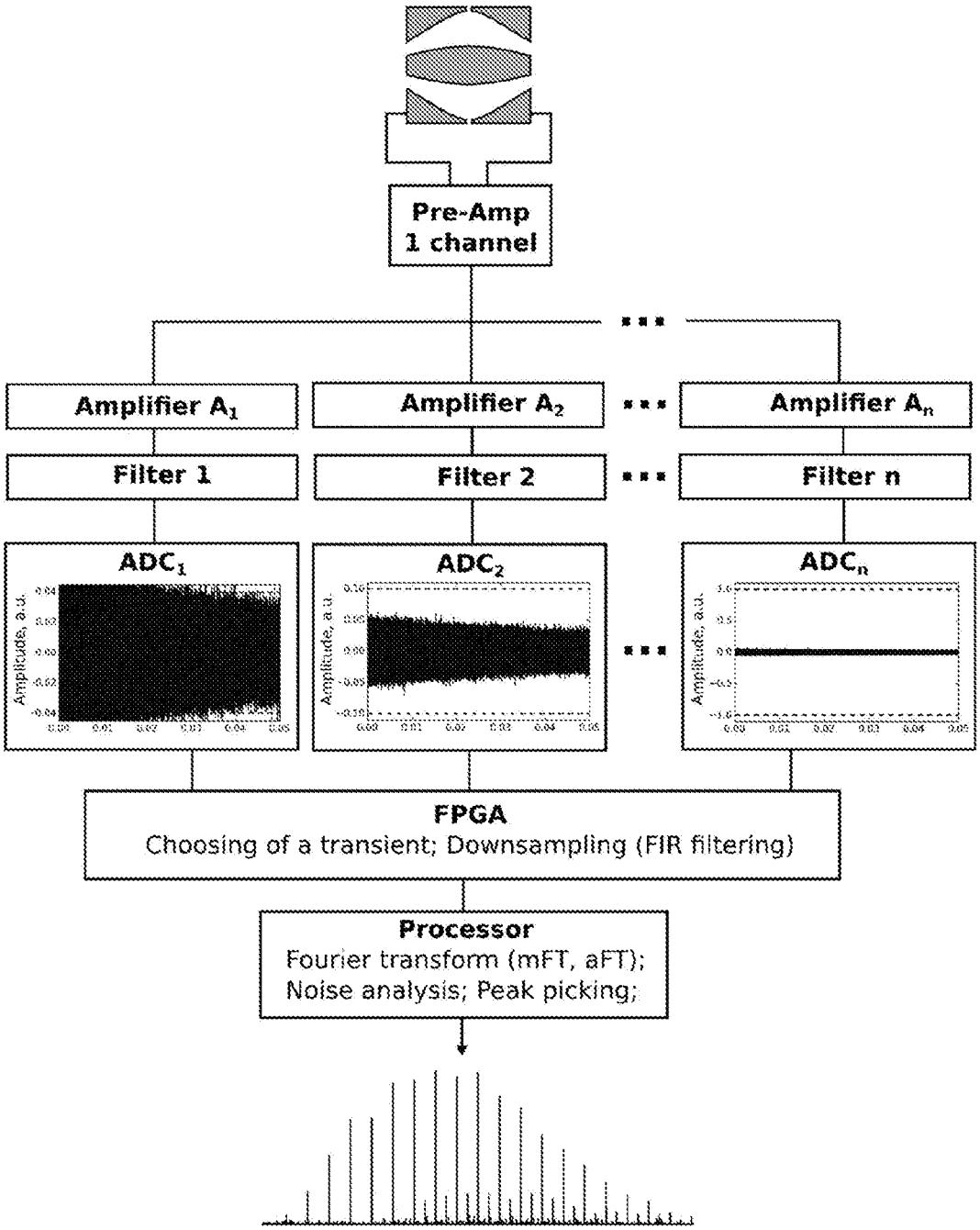
FIG. 8 is a schematic flow diagram representation of the automatic gain control (AGC) functionality for signal amplification of an example of an apparatus according to the present invention when such apparatus is coupled to a Fourier transform mass spectrometer (an Orbitrap FTMS is shown by example)
Figure 9:
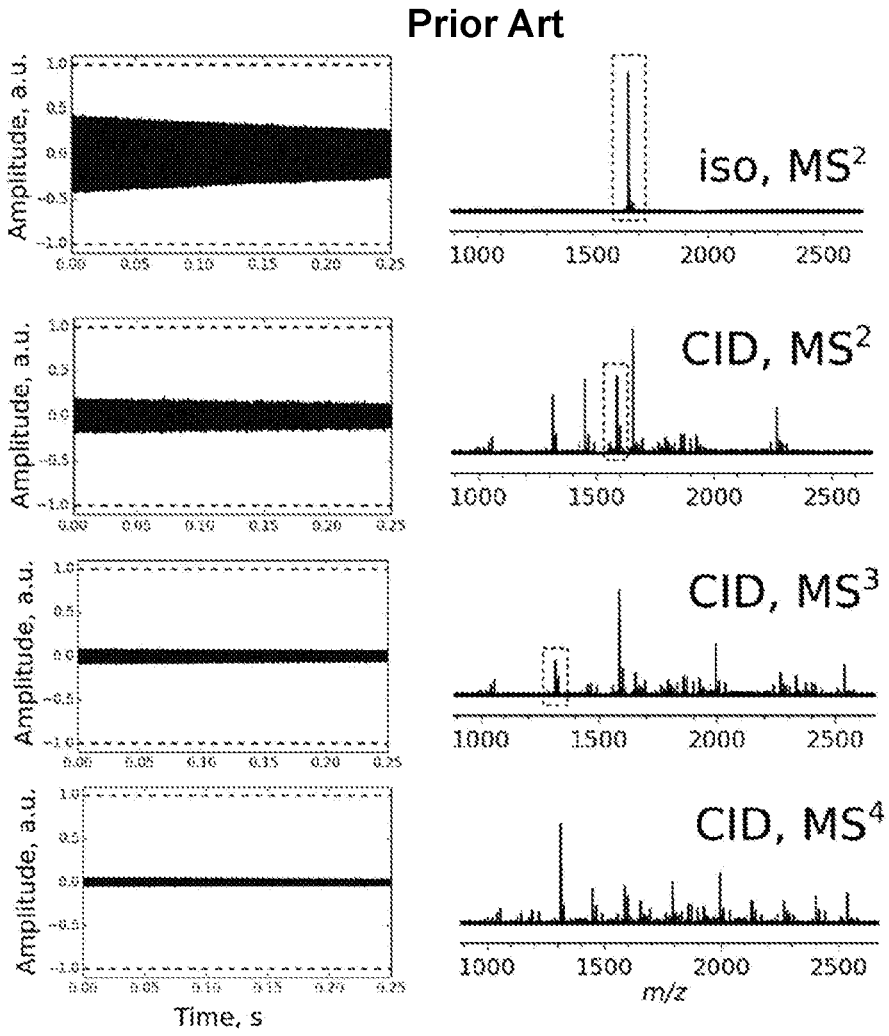
FIG. 9 shows examples of transient signals (left panels) in sequential stages, shown from top to bottom, of $MS^n$-type analysis of a small molecule or a peptide (corresponding mass spectra are shown in the right panels) according to the prior art with under-estimated amplification gains, demonstrating reduction of transient signal amplitude after each fragmentation event (collisional induced dissociation (CID) with n=4 is shown by example)
Figure 10:
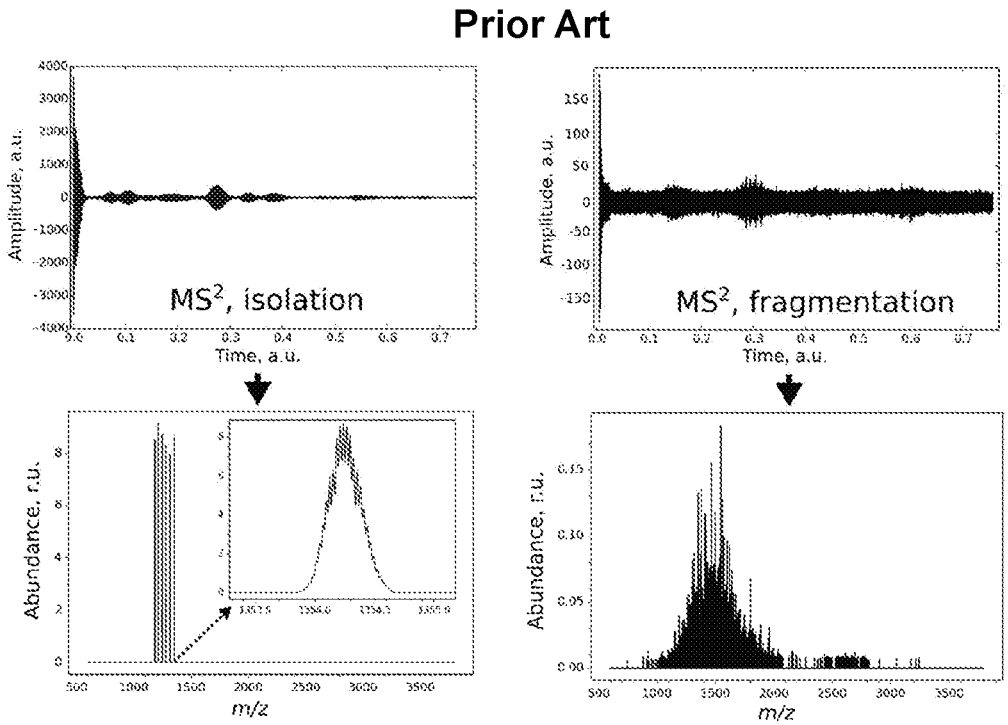
FIG. 10 shows examples of transient signals (top panels) in sequential stages, shown from left to right, of $MS^2$-type analysis of a large molecule or a protein (corresponding mass spectra are shown in bottom panels) according to the prior art with under-estimated amplification gains, demonstrating substantial reduction of transient signal amplitude after the fragmentation event.

An amplitude analyzer is provided in the digital signal processing sub-system, when n>1, to reject from the n digital variants received for each individual transient signal those that are clipped, if any, and then to select from the remaining variants one that, for example, was acquired with maximum amplification factor in the signal conditioning sub-system, 16. Thus, implementation of the automatic gain control (AGC) functionality for signal amplification allows controlling the amplification gain with which a transient signal is digitized by means of analysis of amplitudes of the n digital variants of a transient signal, as depicted in FIG. 8.

Figure 11:
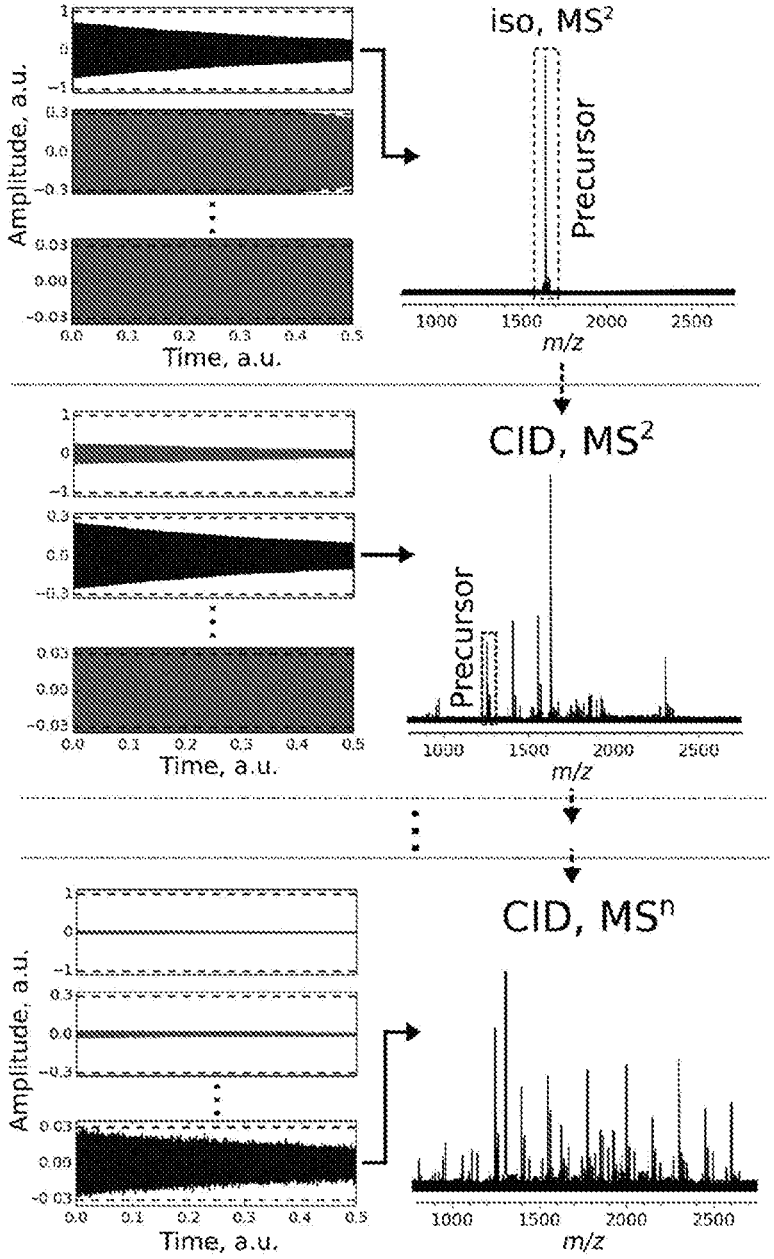
FIG. 11 is a schematic flow diagram representation of $MS^n$-type analysis of a small molecule (e.g., a peptide) using an example of an apparatus according to the present invention with the automatic gain control (AGC) functionality for signal amplification.
Figure 12:
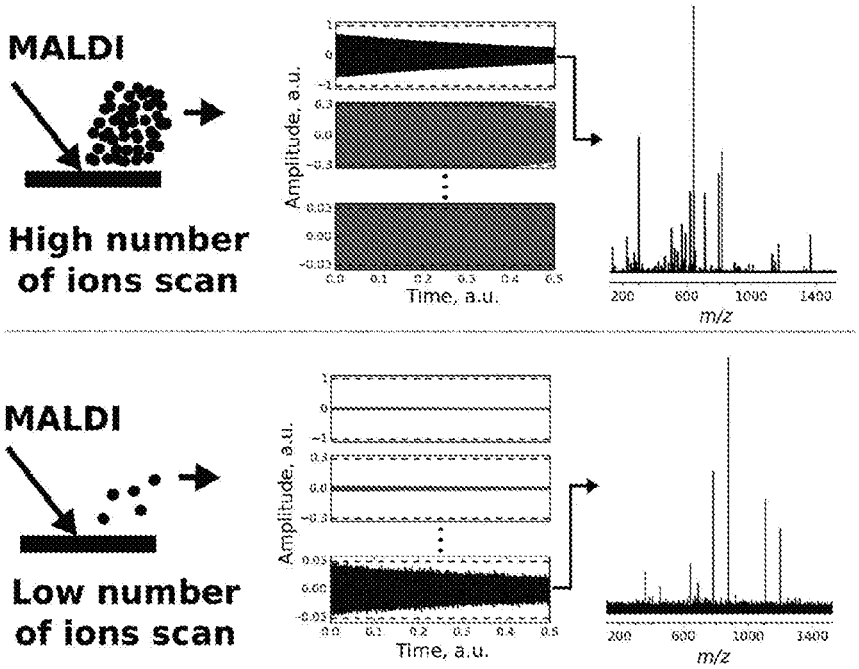
FIG. 12 is a schematic flow diagram representation of mass spectral analysis with fluctuating ion sources using an example of an apparatus according to the present invention with the automatic gain control (AGC) functionality for signal amplification (MALDI ion source is shown by example). Fluctuating ion sources refer to significant (e.g., 2-10 fold) variation in the number of ions (charges) injected into a mass analyzer between different single experiments (scans) within the same experiment (which may contain, for example 100-1000 scans)

The amplification gain control for transient signal digitization allows eliminating sensitivity drop in MS and $MS^n$ experiments, as well as in those experiments that employ fluctuating ion sources. For example, schematic flow diagrams of applications of the AGC for signal amplification in $MS^n$ and MALDI experiments are shown in FIGS. 11 and 12, respectively. Application example depicted in FIG. 11 may refer to structural analysis of small molecules, e.g., natural products, when after precursor ion selection and isolation (FIG. 11 top panel) two or more fragmentation steps are required for in-depth molecular structural analysis. Typically, 3-4 MS/MS stages are performed for small molecule analysis using ESI MS/MS. Isolation of precursor ions at each stage can take place in an ion trap, e.g., linear ion trap, hyphenated to a high resolution FTMS mass analyzer. Similar approach of multistage MS/MS can be also applied to analysis of protein complexes, for example using native mass spectrometry. When protein complexes are analyzed, protein subunits can be first ejected out of a complex (MS/MS stage), followed by subunit fragmentation (MS/MS/MS stage). In FIG. 11 CID is shown as a fragmentation method, whereas other tandem MS methods can be applied, including electron transfer dissociation, electron capture dissociation, higher energy collision induced dissociation, infrared multiphoton dissociation and ultraviolet photodissociation. Examples shown in FIG. 12 illustrate applications with unpredictable and highly variable numbers of ions (charges) between scans (not necessarily consecutive), shown using the case of MALDI-based MS. The latter method is one of the most commonly employed ones for imaging MS applications. Other ionization methods employed for imaging include desorption electrospray ionization (DESI), secondary ion mass spectrometry (SIMS), and LDI without matrix application. According to the present invention, transient amplification gain is data-dependent and is thus selected out of several transients acquired in parallel for each scan.

Figure 13:
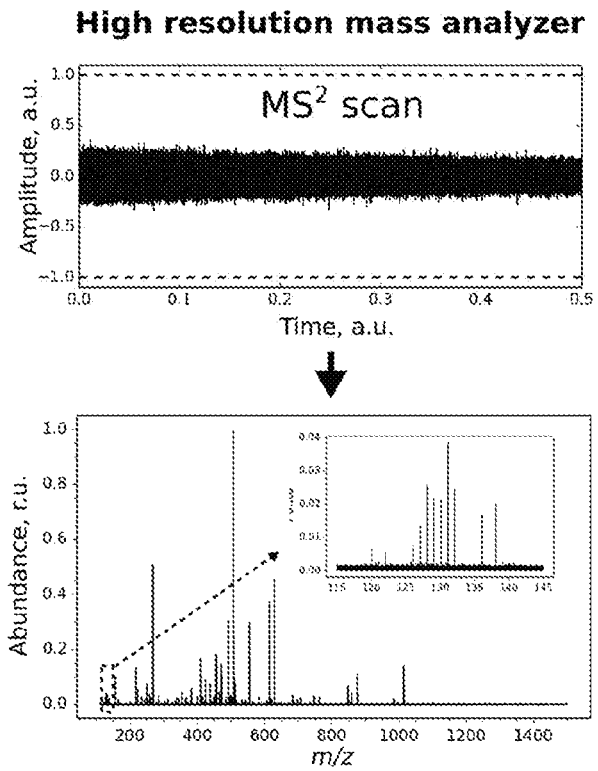
FIG. 13 shows examples of a transient signal (top panel) and a corresponding mass spectrum (bottom panel) of an $MS^2$ event in quantitative proteomics experiments with isobaric labeling (e.g., TMT or iTRAQ labels) using a Fourier transform mass analyzer according to the prior art; the transient signal was acquired in a broad m/z range including the reporter region shown in the inset in bottom panel.
Figure 14:
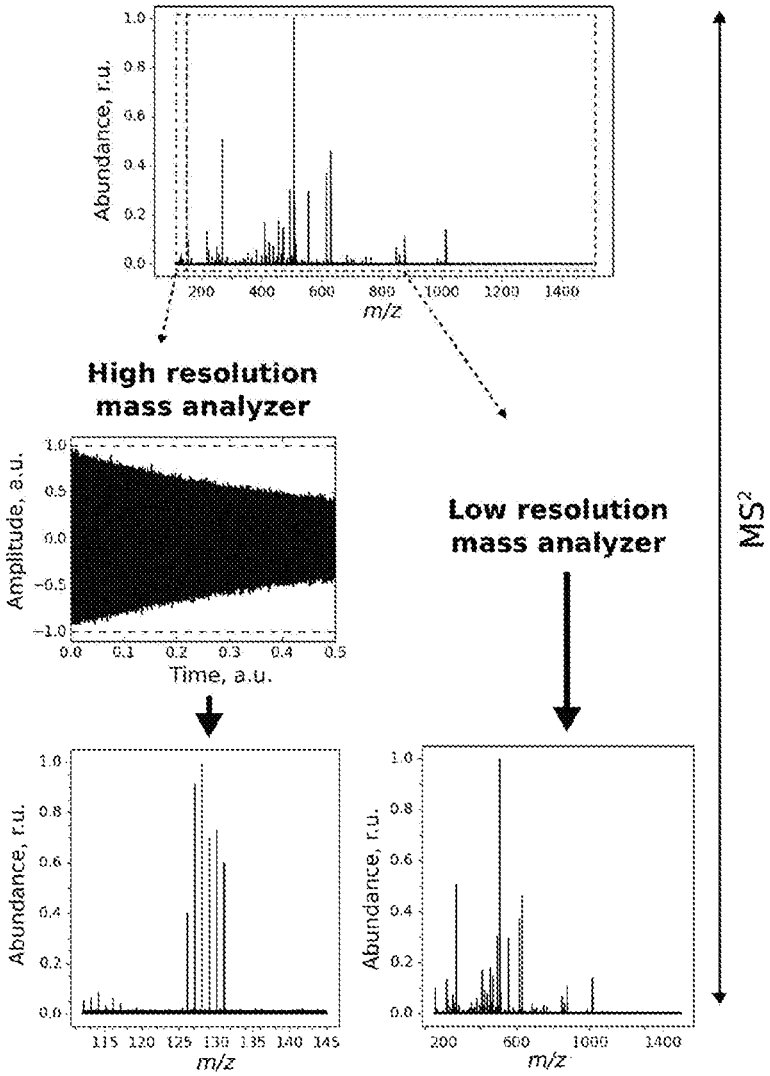
FIG. 14 is a schematic flow diagram representation of an $MS^2$ event in quantitative proteomics experiments with isobaric labeling (e.g., TMT or iTRAQ labels) where the transient signal and corresponding mass spectrum are acquired for a narrow m/z range with reporter ions using a Fourier transform mass analyzer in conjunction with an example of an apparatus according to the present invention with the automatic gain control (AGC) functionality for signal amplification, whereas the mass spectrum including the higher m/z region may be separately acquired using a another, for example low resolution, mass analyzer in parallel with the acquisition of the above-mentioned narrow-m/z-range mass spectrum.
Figure 15A:
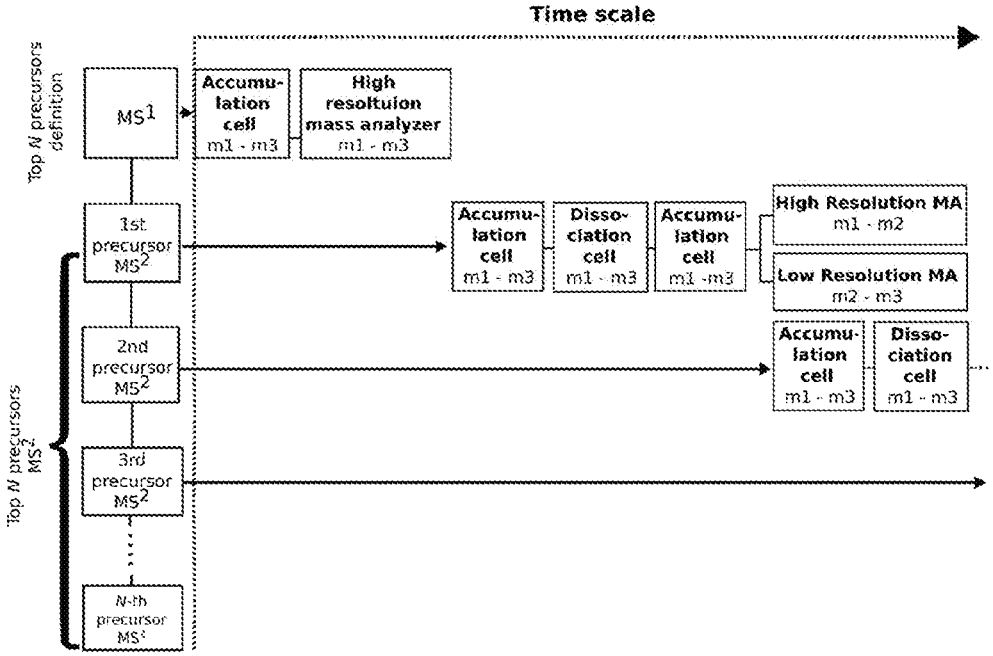
FIG. 15A is a schematic flow diagram representation of a "top N"-experiment with isobaric labeling (e.g., TMT or iTRAQ labelling approaches) where ion accumulation and fragmentation (dissociation) events are carried out in parallel with trapping and analysis of ions in Fourier transform and another, for example, low resolution mass analyzers for the lower m/z (reporter ions) and higher m/z regions respectively, wherein transient signals and corresponding mass spectra for the lower m/z region are acquired using an example of an apparatus according to the present invention.
Figure 15B:
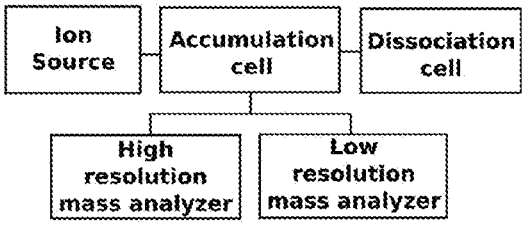
FIG. 15B is a schematic block diagram representation of a mass spectrometer for a parallel and separate acquisition of transient signals in the lower m/z (reporter ions) and broad m/z ranges "top N"-experiment with isobaric labeling (e.g., TMT or iTRAQ labels) according to the present invention.

Similarly, according to the present invention, the sensitivity can be increased in quantitative proteomics experiments, for example using isobaric labeling (as employed in multichannel TMT, iTRAQ, neutron encoded parallel reaction monitoring or NeuCode PRM, and neutron encoded stable isotopic labelling in amino acid cell culture or NeuCode SILAC) and in quantitative metabolomics experiments, for example using isobaric labeling of lipids, FIGS. 13-15. In the listed above cases of quantitative proteomics/metabolomics mass difference between reporter or other ions to be distinguished typically varies between 0.5-50 mDa, with the most common mass difference of 6.3 mDa. Unlike in the prior art, in the present invention transient signals are acquired for a narrow m/z range, limited to the region of interest where peaks to resolve are located, for example reporter m/z region in TMT/iTRAQ approaches, using Fourier transform mass analyzer and the AGC for signal amplification, whereas, mass spectra in a broad m/z region including higher or lower m/z values are separately acquired with, for example, a low resolution mass analyzer, see FIG. 15B. A particular example of a mass spectrometer having architecture similar to the one described in FIG. 15B is a tribrid orbitrap-routing multipole-linear ion trap mass spectrometer, commercially known as Orbitrap™ Fusion™ Lumos™ from Thermo Scientific (Bremen, Germany). FIG. 13 shows a typical multichannel quantitative proteomics experiment of TMT/iIRAQ approach, which corresponds to the prior art. Experimental sequence corresponding to the present invention follows an approach visualized in FIG. 14. Number of quantitation channels in FIGS. 13 and 14 can be equal to, for example, 6 . . . 20, or more. A particular example is a 10-plex TMT protein quantitation approach with 6.3 mDa splitting between 3 pairs of reporter ions. Furthermore, FIG. 15A describes a natural extension of experimental sequence shown in FIG. 14 aiming to increase the number of precursor ions analyzed per experiment in quantitative proteomics. Whereas in a typical TMT experiment, about 10-20 peptides, for example selected as the most abundant ones in the given moment of time, can be potentially analyzed per each MS/MS or MS/MS/MS cycle, in the present invention the number of targeted peptides can be further increased to, for example, 50-100 potentially addressable peptides per each MS/MS or MS/MS/MS cycle. That may be achieved due to the increased quality of each transient leading to reduced, for example 2 . . . 10-fold, transient duration required to resolve the reporter ions, for example using super-resolution methods of signal processing, and to the optimized sensitivity in each measurement. Reduced influence of ions from the complementary part of the mass spectrum leads to the increased frequency and abundance accuracy of the reporter ions. In a similar manner extension of TMT/iTRAQ protein quantitation to MS/MS/MS approach can be considered. Application of super-resolution methods of signal processing, e.g., least-squares fitting, further benefits from the a priori known information of the masses of reporter ions in TMT/iTRAQ protein quantitation, as well as similar isobaric-tag based approaches.

In a complementary analytical approach, herein described data-dependent transient amplification (transient automatic gain control) can be applied along the time-axis of the transient signal. For example, the whole transient can be split into a left and right sections and each of these transient sections can be amplified with a corresponding amplification factor. More than two sections can be considered. Particular cases for such applications can be with transients decaying in time or transients with pronounced bit patterns as obtained for multiply-charged ions, especially of large molecules, e.g., proteins.

Further Preferred Embodiments

The present invention has several particularly favorable embodiments, aiming for improved performance of analytical instrumentation and related applications, for example as employed using Fourier transform mass spectrometry, including the following:

1. Data acquisition without introduction of substantial non-linear phase distortions to digitized transient signals. There is no analog anti-aliasing filters with a relatively low cut-off frequency, i.e. whose where $f_0 \approx fmax$ where $f_{max}$ is the fundamental frequency for the lowest m/z of interest (e.g., $f_{max}$ of 0.5 . . . 5 MHz). An anti-aliasing filter with a high cut-off frequency, $f_0$, should be employed, exceeding $f_{max}$ by at least an order, and preferably by two orders, of magnitude (e.g. $f_0$=100 MHz). Therefore, signal sampling frequency, fs, of analog-to-digital converter(s) should be set sufficiently high (e.g. fs=250 MHz).
2. The resolution and mass accuracy of mass spectra may be improved due to eliminating introduction of substantial phase distortions to transient signals, providing improved transient signal processing, for example to provide absorption-mode FT spectral representation without phase correction requirements, as well as for least-squares fitting processing.
3. The resolution, sensitivity, and mass accuracy of mass spectra may be improved due to optimized (maximized) duty cycle of transient data acquisition, achieving acquisition of transient signals during full available periods of ion trapping in a mass analyzer.
4. Data acquisition without imposing an upper limit on the maximum detection period of a transient signal. Long transients would result in increased resolution performance and eliminate or reduced the need for frequency reduction using heterodyne detection.
5. The sensitivity of mass spectra may be improved due to optimized analog signal conditioning prior to signal digitization for each mass measurement experiment. The required gain (amplification) is to be determined based on the strength of transient signal in the given experiment instead of the pre-set value based on diverse assumptions, e.g., pre-scan total ion current or target charge value.
6. To enable on-the-fly selection of transient amplification (gain) it is suggested to employ multiple signal amplifiers functioning in parallel. The multiple transients of the same mass measurement provided by the amplifiers are to be digitized simultaneously. Transient(s) providing the most sensitive and artifact-free signal digitization is (are) to be employed for further use.
7. Transient amplification (gain) may be selected based on the information on the accumulated number of charges, provided prior to ion detection. In case if a pre-set target chage is not reached and ion accumulation time reaches the maximum allowed ion accumulation time in a particular MS scan, the gain of the amplifier may be increased.

The invention claimed is:

1. A data acquisition system for acquiring a digitized time-domain signal from a mass spectrometer, the system comprising:

a signal conditioning device including an amplifier and an analog low-pass filter, to amplify and filter an analog signal generated by the mass spectrometer, and to output a conditioned analog signal;

an analog-to-digital converter to convert in real time the conditioned analog signal into a digital data stream;

a digital signal processing device configured for in-line digital signal processing of the digital data stream to generate the digitized time-domain signal, and to digitally decode a digital triggering signal from the mass spectrometer; and a host device having a data processing device to receive the digitized time-domain signal from the digital signal processing device, and to construct a corresponding mass spectra from the digitized time-domain signal, wherein the digital signal processing device includes, a digital decoder to decode a start event and a stop event when generating each individual digitized transient signal in the mass spectrometer, a detection of the stop event is performed by using the digital triggering signal, a digital valve to distinguish individual digitized transient signals in the digital data stream, according to the start event and the stop event, and a digital downsampler based on a digital low-pass filter for reducing data of the individual digitized transient signals, the digital low-pass filter providing a phase function close to a linear function of frequency, a deviation from the linear function resulting from limitations of a digital implementation of the digital low-pass filter.

2. The data acquisition system according to claim 1, wherein the mass spectrometer includes a Fourier transform mass spectrometer using, for ion detection, a signal transducer that is based on induced current sensing.

3. The data acquisition system according to claim 1, wherein a passband of the analog low-pass filter of the signal conditioning device, regarding positive-value frequencies, exceeds a fundamental frequency of ion motion in the mass spectrometer for a lowest mass-to-charge ratio (m/z) value.

4. The data acquisition system according to claim 1, wherein the signal conditioning device comprises:

n amplifiers and n analog low-pass filters, n being an integer number greater than 1, amplification factors of the n amplifiers being divergent, such that the signal conditioning device is configured to amplify and filter the analog signal generated by the mass spectrometer and to output n conditioned analog signals to the analog-to-digital converter.

5. The data acquisition system according to claim 4, wherein the analog-to-digital converter comprises:

n analog-to-digital converters, the n analog-to-digital converters configured to convert in real time the n conditioned analog signals into n digital data streams.

6. The data acquisition system according to claim 5, wherein the digital valve comprises:

n digital valves, the n digital valves configured to distinguish the individual digitized transient signals in the digital data stream, according to the start event and the stop event, wherein the digital downsampler includes n digital downsamplers, the n digital downsamplers configured to process the individual digitized transient signals from the digital data stream.

7. The data acquisition system according to claim 5, wherein the digital signal processing device further comprises:

an amplitude analyzer configured to reject none, one or more digital data streams from the n digital data streams.

8. The data acquisition system according to claim 1, further comprising:

an additional analog input for recording a signal of ion excitation from the mass spectrometer.

9. The data acquisition system according to claim 1, wherein the host device performs further processing of the digitized time-domain signal.

10. The data acquisition system according to claim 1, wherein the host device performs a data-dependent decision to control an operating parameter of the digital signal processing device.

11. The data acquisition system according to claim 1, wherein the host device performs a data-dependent decision to control an operating parameter of the mass spectrometer.

12. A data acquisition method for acquiring digitized time-domain signals from a mass spectrometer, the method comprising:

signal conditioning of an analog signal that is generated in response to ion motion in the mass spectrometer, the signal conditioning including amplifying and anti-aliasing filtering of the analog signal to produce a conditioned analog signal;

analog-to-digital converting the conditioned analog signal into a digital data stream;

digital signal processing of the digital data stream, and digital decoding of a digital triggering signal from the mass spectrometer; and constructing corresponding mass spectra from the digital data stream, wherein the step of digital signal processing includes, decoding a start event and a stop event when generating each individual digitized transient signal in the mass spectrometer, a detection of the stop event is performed by using the digital triggering signal from the mass spectrometer, distinguishing individual digitized transient signals in the digital data stream, based on the start event and the stop event, and digital downsampling with a digital low-pass finite-impulse response (FIR) filtering for reducing data of the individual digitized transient signals, the digital low pass FIR filter providing a phase function close to a linear function of frequency, a deviation from the linear function resulting from limitations of a digital implementation of the digital low-pass FIR filter.

13. The data acquisition method according to claim 12, wherein the mass spectrometer includes a Fourier transform mass spectrometer using for ion detection a signal transducer that is based on induced current sensing.

14. The data acquisition method according to claim 12, wherein a passband of the anti-aliasing filtering, regarding positive-value frequencies, exceeds at least twice the fundamental frequency of ion motion in the mass spectrometer for a lowest mass-to-charge ratio (m/z) value.

15. The data acquisition method according to claim 14, wherein a sampling frequency of the analog-to-digital converting exceeds by at least twice the passband of the anti-aliasing filtering regarding positive-value frequencies.

16. The data acquisition method according to claim 12, wherein the step of constructing the mass spectra includes at least one of signal apodization, zero-padding, Fourier transformation, calculating an absorption-mode Fourier spectrum, and conversion of a frequency axis into a mass-to-charge axis for obtaining resultant mass spectra.

17. The data acquisition method according to claim 16, wherein a linear property of the phase function is parametrized for time-domain least-squares fitting to calculate an initial phase of ions oscillating in the mass spectrometer.

18. The data acquisition method according to claim 17, wherein the initial phase of ions is used to calculate an absorption mode Fourier spectrum.

19. The data acquisition method according to claim 16, wherein a linear property of the phase function is parametrized for time-domain least-squares fitting for calculating ion abundances for mass spectrometry-based identification and quantification of molecules.

20. The data acquisition method according to claim 12, wherein the step of signal conditioning, the analog-to-digital converting, the distinguishing individual digitized transient signals, and the digital downsampling are performed with n diverse amplification factors, n being an integer greater than 1, to produce n digital variants for each individual transient signal.

21. The data acquisition method according to claim 20, wherein the digital signal processing further comprises:

analyzing amplitudes of the n digital variants to reject none, one or more digital variants from the n digital variants.

* * * * *